US005851292A

United States Patent [19]

Minoura et al.

[11] Patent Number: 5,851,292

[45] Date of Patent: Dec. 22, 1998

[54] ELECTROSTATIC COATING METHOD AND APPARATUS

[75] Inventors: Shuuji Minoura; Yukihito Ono; Osamu Kageyama; Takashi Shimada; Toshiyuki Kokubo, all of Sayama, Japan

[73] Assignee: Honda Giken Kogyo Kabushiki Kaisha, Tokyo, Japan

[21] Appl. No.: 721,961

[22] Filed: Sep. 27, 1996

[30] Foreign Application Priority Data

Nov. 20, 1995 [JP] Japan ..... 7-301673
Nov. 20, 1995 [JP] Japan ..... 7-301687

[51] Int. Cl.[6] ..... B05B 5/025

[52] U.S. Cl. ..... 118/629; 239/690; 239/DIG. 14; 118/620; 361/228

[58] Field of Search ..... 239/690, 696, 239/112, 113, 104, DIG. 14, 569, 574; 118/620, 621, 629; 137/861, 896–898, 605–607, 99.5, 237, 238; 251/149, 149.1, 149.3, 149.9; 361/227, 228

[56] References Cited

U.S. PATENT DOCUMENTS

| | | | |
|---|---|---|---|
| 3,674,205 | 7/1972 | Kock | 239/112 |
| 4,422,576 | 12/1983 | Saito et al. | 239/112 |
| 4,771,729 | 9/1988 | Planert et al. . | |
| 4,785,760 | 11/1988 | Tholome . | |
| 5,094,389 | 3/1992 | Giroux et al. . | |
| 5,100,690 | 3/1992 | Planert et al. . | |
| 5,106,024 | 4/1992 | Frene | 239/112 |
| 5,152,466 | 10/1992 | Matushita et al. . | |
| 5,249,748 | 10/1993 | Lacchia et al. . | |
| 5,255,856 | 10/1993 | Ishibashi et al. . | |
| 5,288,029 | 2/1994 | Ishibashi et al. | 239/690 |
| 5,288,525 | 2/1994 | Diana | 239/112 |
| 5,378,505 | 1/1995 | Kubota et al. . | |
| 5,647,542 | 7/1997 | Diana | 239/690 |

FOREIGN PATENT DOCUMENTS

| | | |
|---|---|---|
| 0435005 | 7/1991 | European Pat. Off. . |
| 0435005A2 | 7/1991 | European Pat. Off. . |
| 0620046A1 | 10/1994 | European Pat. Off. . |
| A1-0620046 | 10/1994 | European Pat. Off. . |
| 463156 | 2/1992 | Japan . |
| 487755 | 7/1992 | Japan . |
| A-8-257443 | 3/1995 | Japan . |
| 2246527 | 2/1992 | United Kingdom . |

*Primary Examiner*—David A. Simmons
*Assistant Examiner*—Calvin Padgett
*Attorney, Agent, or Firm*—Birch, Stewart Kolasch & Birch, LLP

[57] ABSTRACT

An apparatus for electrostatically coating a workpiece has an insulating separator valve mechanism for electrically separating a paint supply passage for supplying an electrically conductive paint to a coating gun, into a paint supply passage to which a high voltage will be applied and a paint supply passage to which no high voltage will be applied. The insulating separator valve mechanism has a first valve body connectable to said paint supply passage through a first on/off valve, and a second valve body connectable to said paint supply passage through a second on/off valve. While the first and second valve bodies are connected to each other and the first and second on/off valves are closed, a paint trap is cleaned by a cleaning medium, which is discharged into a second dump passage. A process of cleaning the paint trap for a paint color change is efficiently and reliably carried out to reliably remove paint residuals from the paint trap.

18 Claims, 19 Drawing Sheets

222
230
242
240
254
252
250
218a
220b
248
246
238(258)
244
228
236(256)
274
262
272
264
268
276
270
260
220a
218b
282
280
284
216
306
310
308
302
214

ELECTROSTATIC COATING METHOD AND APPARATUS

BACKGROUND OF THE INVENTION

1. Field of the Invention

The present invention relates to a method of and an apparatus for electrostatically coating a workpiece with an electrically conductive paint which is supplied to a coating gun through a paint supply passage.

2. Description of the Related Art

Generally, an electrostatic coating apparatus for coating workpieces with an electrically conductive paint have a coating gun to which a high voltage will be applied. When the coating gun is supplied with the electrically conductive paint from a paint source through a paint supply passage, the coating gun applies a coating of the electrically conductive paint to a workpiece, thereby electrostatically coating the workpiece. For electrostatically coating the workpiece with the electrically conductive paint ejected from the coating gun, it is necessary to electrically insulate the coating gun from the paint supply source.

There has been known an electrostatic coating apparatus for applying a coating of electrically conductive paint with a coating gun which communicates with a paint supply source through a paint supply passage that incorporates an insulating distance. For example, reference should be made to Japanese laid-open utility model publication No. 4-87755.

The known electrostatic coating apparatus will briefly be described below with reference to FIG. 19 of the accompanying drawings. As shown in FIG. 19, a paint supply passage 2 connected to a paint supply source 1 has a male coupler 4 which is movable back and forth by a cylinder 3. The male coupler 4 can be connected to a female coupler 5 which is coupled to a paint inlet passage 6 joined to a pump 7. The pump 7 is connected through a paint outlet passage 8 to a coating machine 9. The female coupler 5 is surrounded by a cleaning cover 10 to which a cleaning solution supply pipe 11 and a cleaning solution discharge pipe 12 are connected.

When a paint of a desired color is supplied from the paint supply source 1 to the paint supply passage 2 while the male coupler 4 and the female coupler 5 are connected to each other, the supplied paint flows through the male coupler 4 and the female coupler 5 and fills the pump 7 through the paint inlet passage 6. The paint is then delivered from the pump 7 through the paint outlet passage 8 to the coating machine 9. When the male coupler 4 and the female coupler 5 are disconnected from each other, providing an insulating distance therebetween, the pump 7 is actuated to eject the paint from the coating machine 9.

For ejecting a paint of another color from the coating machine 9, the coating operation has to be interrupted, and the entire coating line ranging from the paint supply source 1 to the coating machine 9 has to be cleaned. Therefore, each time a paint of a different color is to be applied, it is necessary to clean the entire coating line. As a result, the time required to clean the electrostatic coating apparatus is long, and the process of cleaning the electrostatic coating apparatus is inefficient.

Another problem with the above conventional electrostatic coating apparatus is that after the cleaning cover 10 has been cleaned, it takes a long period of time to dry the cleaning solution supply pipe 11 and the cleaning solution discharge pipe 12, resulting in the cleaning process being inefficient.

Furthermore, the paint tends to be deposited on the inner surface of the cleaning solution discharge pipe 12, and the deposited paint layer is liable to cause a current leakage under the high voltage. The need for a dedicated mechanism for cleaning the cleaning solution discharge pipe 12 entails an added cost.

Another prior electrostatic coating apparatus with an insulating capability is revealed in Japanese laid-open patent publication No. 4-63156. The revealed electrostatic coating apparatus has a reciprocating pump for discharging an electrically conductive paint, introduced from an inlet port through a paint supply pipe, to an outlet port at a given rate. There are selectively connected to the reciprocating pipe a paint pipe for supplying the electrically conductive paint discharged from the reciprocating pump to an electrostatic coating machine, and a drain pipe for draining a remaining paint in the reciprocating pump, together with cleaning air and cleaning solution supplied from the paint supply pipe, through a discharge pipe. The paint supply pipe and the drain pipe are disengageably connected respectively to respective connector ports of the reciprocating pump.

The drain pipe and the discharge pipe, which jointly provide a dump passage, are separable from each other for insulating them from each other. Therefore, the paint contained in the drain is apt to be deposited in junctions between the drain pipe, the corresponding connector port of the pump, and the discharge pipe because the dump passage which is separable is not required to be fully cleaned, is cleaned in a short period of time, and hence tends to trap paint residues. The junctions are not sufficiently sealed, and when the drain pipe and the discharge pipe are separated from each other, the drain containing the paint flows down therefrom, bringing about a current leakage under the high voltage.

Since the paint supply pipe is disengageably connected to the corresponding connector port of the reciprocating pump, the junction between the paint supply pipe and the corresponding connector port is not sufficiently sealed due to a paint deposit, and suffers a current leakage under the high voltage due to the paint that runs from the junction.

The paint supply pipe is separated from the corresponding connector port of the pump after the pair has been introduced from the paint supply pipe into the reciprocating pump. Consequently, the paint supply pipe is disconnected from and connected to the corresponding connector port of the reciprocating pump in each cycle of supplying the paint to the reciprocating pump. As a result, it is highly likely for the junction to trap the paint and air. When the paint supply pipe is connected to the corresponding connector port of the reciprocating pump and the paint is supplied from the paint supply pipe to the reciprocating pump, the air trapped in the junction is possibly delivered together with the trapped paint to the reciprocating pump. The air thus delivered may be included as air bubbles in the coating applied to the workpiece, lowering the quality of the coating.

SUMMARY OF THE INVENTION

It is a general object of the present invention to provide a method of and an apparatus for electrostatically coating a workpiece while allowing paint passages to be cleaned efficiently and reliably for changing paints of different colors.

A principal object of the present invention is to provide a method of and an apparatus for electrostatically coating a workpiece while reliably cleaning detachable joints between passages and effectively preventing a paint from being trapped in the joints.

Another principal object of the present invention is to provide an apparatus for electrostatically coating a workpiece while allowing paint passages from being cleaned and dried efficiently and reliably, the apparatus having a relatively simple structure.

Still another principal object of the present invention is to provide a method of and an apparatus for electrostatically coating a workpiece while reliably removing trapped air from joints between passages and efficiently applying a high-quality coating to the workpiece.

The above and other objects, features, and advantages of the present invention will become more apparent from the following description when taken in conjunction with the accompanying drawings in which preferred embodiments of the present invention are shown by way of example.

DETAILED DESCRIPTION OF THE PREFERRED EMBODIMENTS

Figure 1:
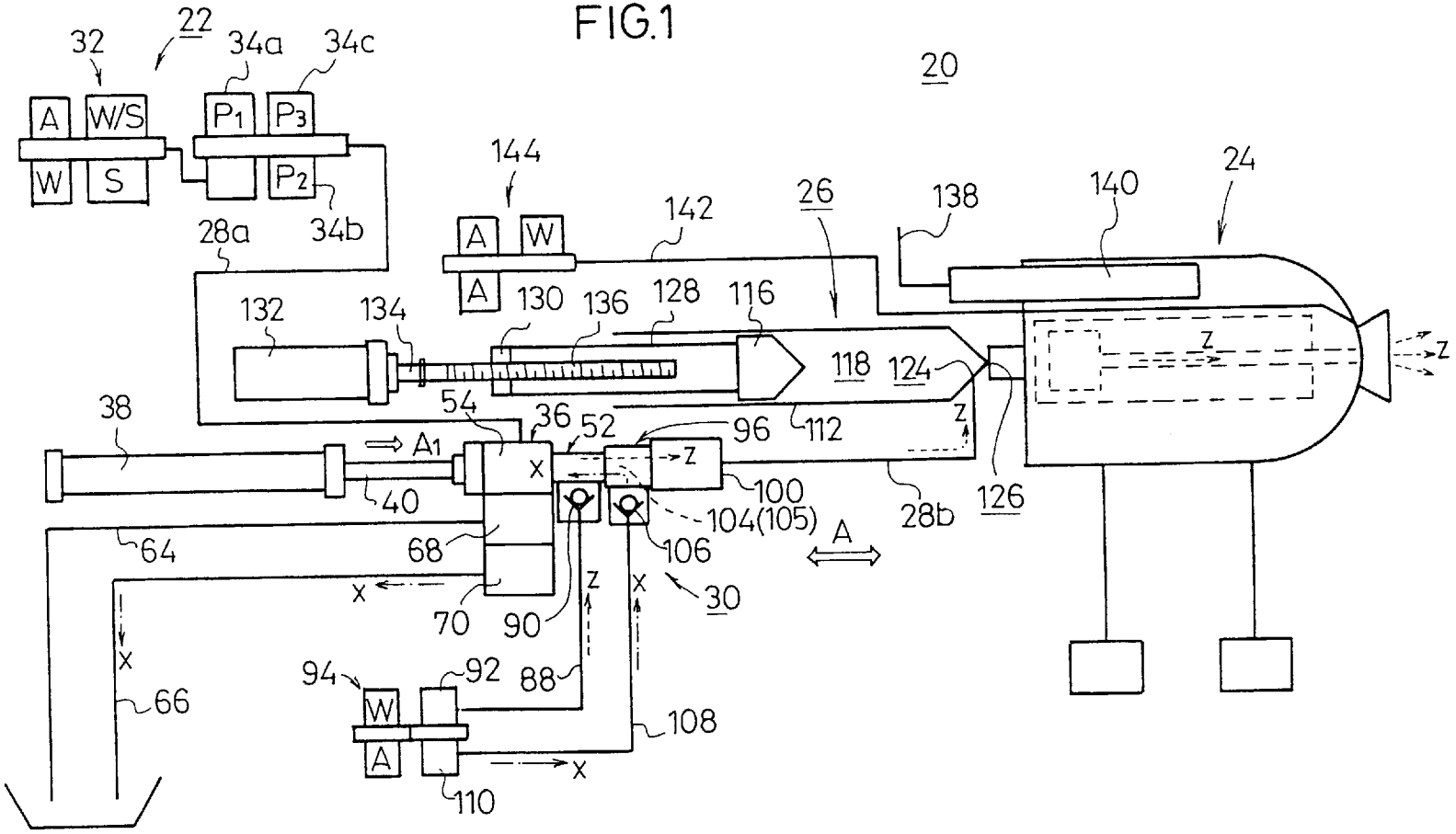
FIG. 1 is a schematic diagram of an electrostatic coating apparatus according to a first embodiment of the present invention.

As shown in FIG. 1, an electrostatic coating apparatus 20 according to a first embodiment of the present invention generally comprises a grounded paint color changer valve mechanism 22 for selectively supplying a plurality of electrically conductive paints of different colors, a coating gun 24 for ejecting a supplied paint toward a workpiece, an intermediate paint trap tank 26 interposed between the paint color changer valve mechanism 22 and the coating gun 24, and an insulating separator valve mechanism 30 for disconnectably connecting paint supply passages 28*a*, 28*b* extending between the paint color changer valve mechanism 22 and the intermediate paint trap tank 26.

The paint color changer valve mechanism 22 comprises a first cleaning valve 32 for controlling the supply of water (W), a cleaning solution (S), and air (A), and a plurality of paint valves 34*a*, 34*b*, 34*c* for supplying different paints (P1, P2, P3), respectively.

Figure 2:
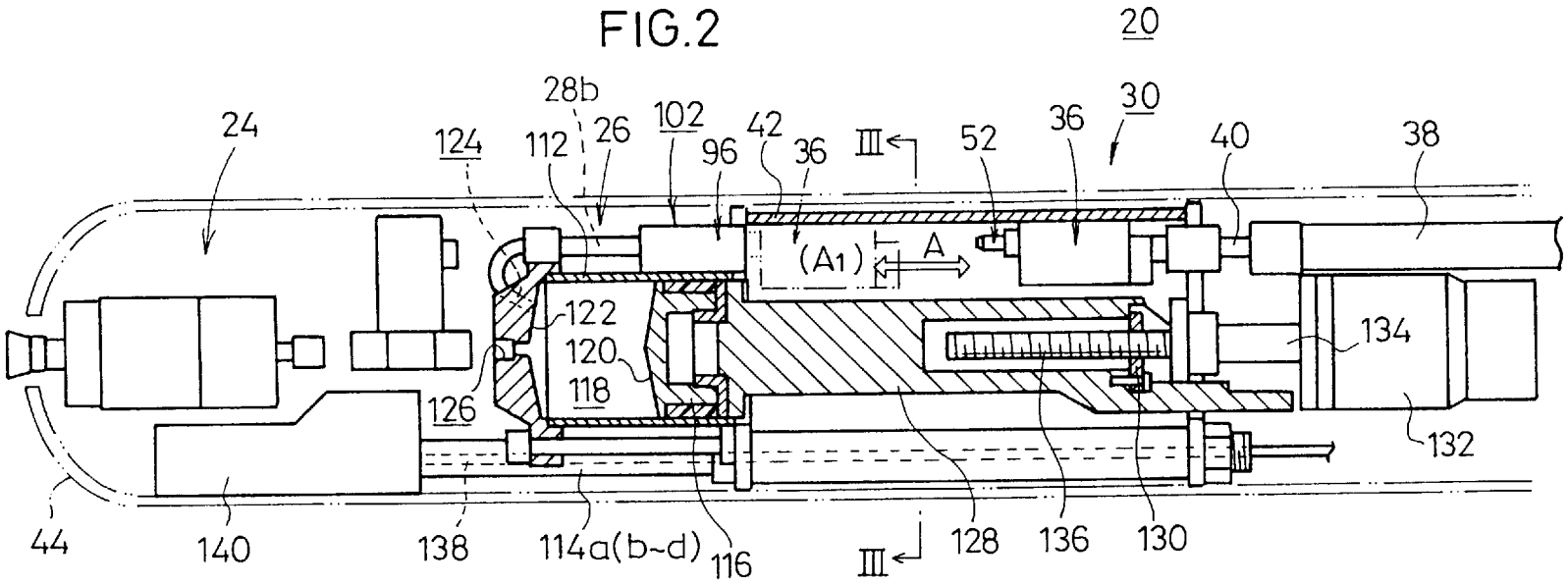
FIG. 2 is a longitudinal cross-sectional view of a coating gun of the electrostatic coating apparatus shown in FIG. 1.

The insulating separator valve mechanism 30 has a movable block 36 connected to the paint color changer valve mechanism 22 through the paint supply passage 28*a* to which no high voltage will be applied. As shown in FIG. 2, the movable block 36 is connected to a rod 40 extending from an air cylinder 38 (actuating means) for movement in the directions indicated by the arrow A while being guided by a rail 42.

Figure 3:
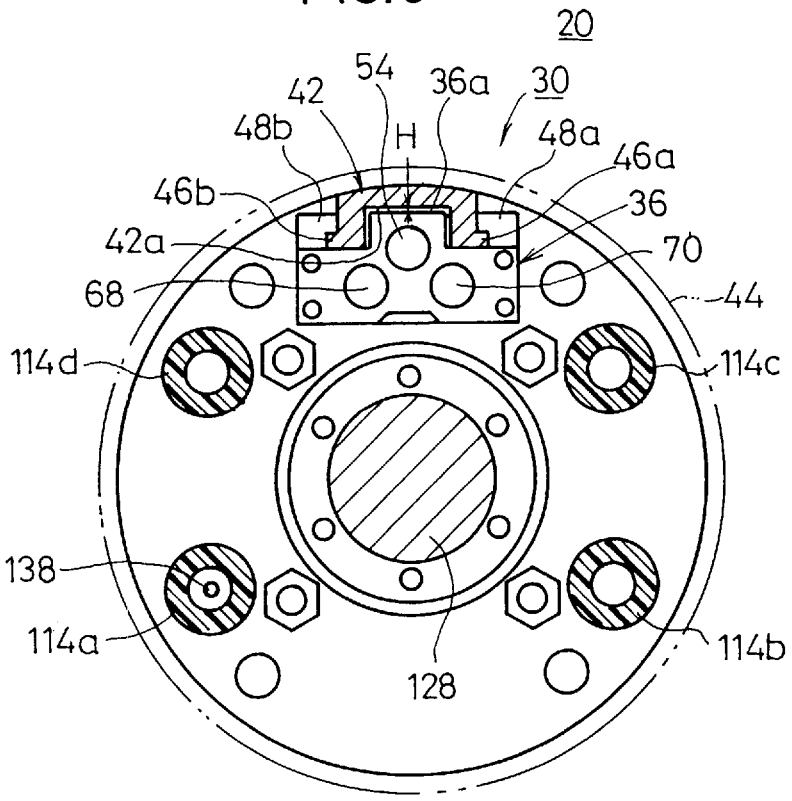
FIG. 3 is a cross-sectional view taken along line III—III of FIG. 2.

As shown in FIG. 3, the rail 42 is fixedly mounted in a casing 44 of the electrostatic coating apparatus 20, and has a substantially arch-shaped cross section. The rail 42 has a pair of legs extending radially inwardly of the casing 44 and having respective ledges 46*a*, 46*b* projecting away from each other from the respective lower ends thereof. Two retainers 48*a*, 48*b* are fixed to an upper surface of the movable block 36 and engage the respective ledges 46*a*, 46*b* to support the movable block 36 on the ledges 46*a*, 46*b*. Specifically, the movable block 36 is supported on horizontal and vertical surfaces of the ledges 46*a*, 46*b* through the retainers 48*a*, 48*b*, with a vertical gap H left between an upper end surface 36*a* of the movable block 36 and a lower end surface 42*a* of the rail 42.

Figure 4:
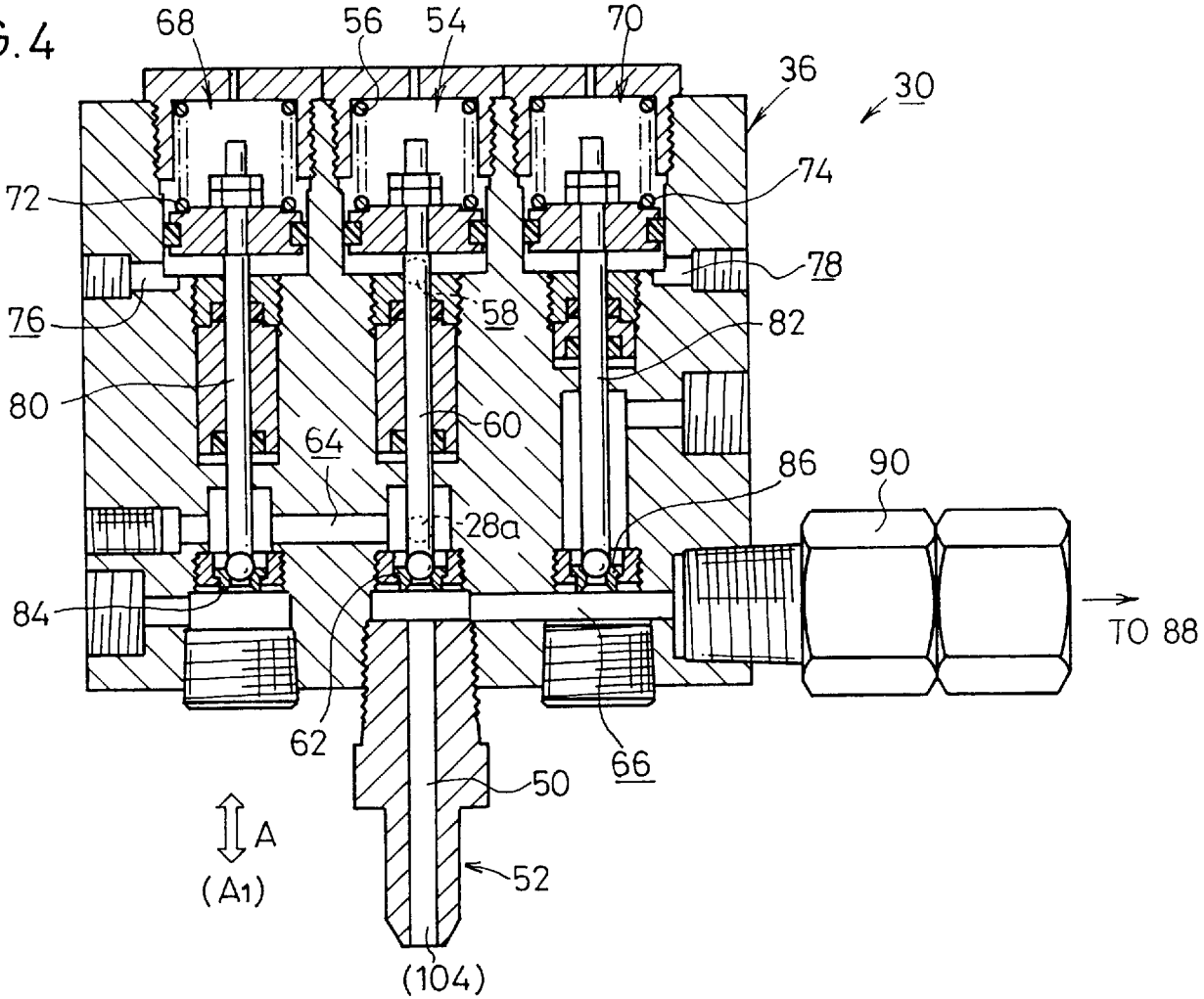
FIG. 4 is a cross-sectional view of a movable block of the electrostatic coating apparatus shown in FIG. 1.

As shown in FIG. 4, the movable block 36 has a first valve body 52 having a first communication hole 50 defined therein which selectively communicates with the paint supply passage 28*a* through a first on/off valve 54. The first on/off valve 54 comprises a valve body 60 axially movable by resilient forces from a spring 56 and air delivered into and out of an air port 58, and a valve seat 62 for receiving the valve body 60.

The movable block 36 also has a first dump passage 64 branched from the paint supply passage 28*a* near the first valve body 52, and a second dump passage 66 branched from the paint supply passage 28*a* and a communication hole 104 (described later on). The first and second dump passages 64, 66 have respective first and second dump valves 68, 70 disposed closely to the first on/off valve 54 for selectively opening and closing the first and second dump passages 64, 66, respectively. The first and second dump valves 68, 70 comprise respective valve bodies 80, 82 axially movable by resilient forces from respective springs 72, 74 and air delivered into and out of respective air 76, 78, and respective valve seats 84, 86 for receiving the respective valve bodies 80, 82.

The first communication hole 50 defined in the first valve body 52 is held in communication with a first cleaning passage 88 through the second dump passage 66. A first check valve 90 is mounted on the movable block 36 for allowing water and air to flow only from the first cleaning passage 88 into the first communication hole 50. As shown in FIG. 1, the first cleaning passage 88 communicates with a second cleaning valve 94 through a first directional control valve 92. The second cleaning valve 94 serves to control the supply of water (W) and air (A).

Figure 5:
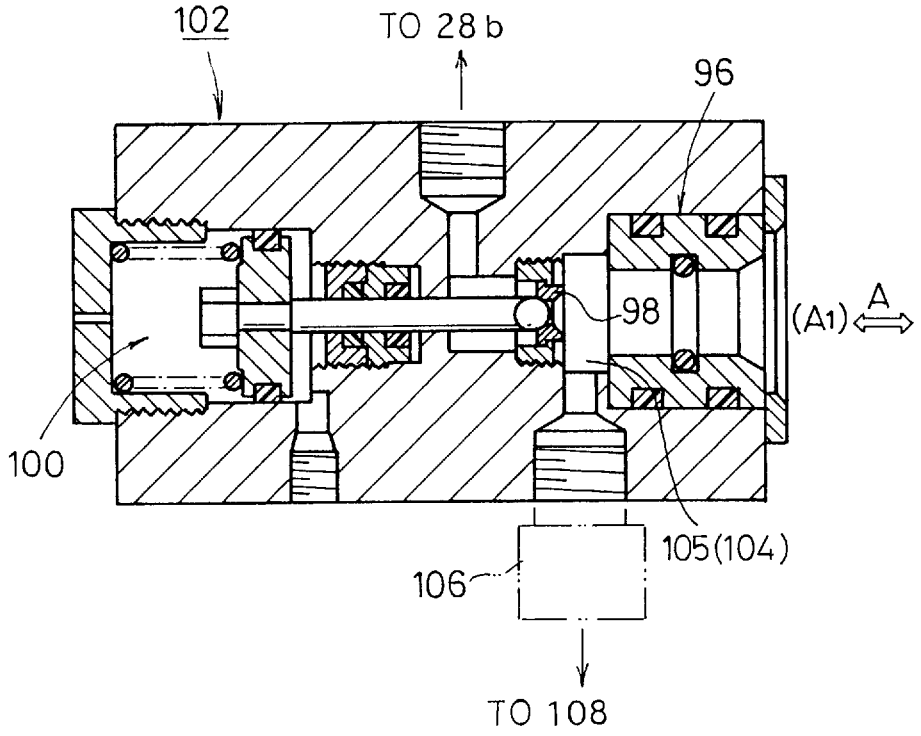
FIG. 5 is a cross-sectional view of a fixed block of the electrostatic coating apparatus shown in FIG. 1.

As shown in FIG. 2, a second valve body 96 is fixedly disposed in confronting relation to the first valve body 52. As shown in FIG. 5, the second valve body 96 has a second communication hole 98 defined therein which selectively communicates with the paint supply passage 28*b* to which a high voltage will be applied, through a second on/off valve 100. The second valve body 96 and the second on/off valve 100 are accommodated in a fixed block 102. The second valve body 96 serves as a female coupler for receiving the first valve body 52 which serves as a male coupler.

When the first and second valve bodies 52, 96 are coupled to each other, their first and second communication holes 50, 98 jointly provide a communication hole 104 in the insulating separator valve mechanism 30. With the first on/off valve 54 closed, the second dump passage 66 is branched from the communication hole 104 (see FIG. 4).

The communication hole 104 provides a paint trap 105 which is established when the first and second valve bodies 52, 96 are coupled to each other and the first and second on/off valves 54, 100 are closed. The paint trap 105 thus formed tends to trap an electrically conductive paint that has remained in the communication hole 104. As shown in FIG. 5, the paint trap 105 communicates through a second check valve 106 with a second cleaning passage 108, which communicates through a second directional control valve 110 with the second cleaning valve 94 (see FIG. 1). The second cleaning valve 94 serves as cleaning means for cleaning the paint trap 105 when the first and second valve bodies 52, 96 are coupled to each other and the first and second on/off valves 54, 100 are closed.

As shown in FIG. 2, the intermediate paint trap tank 26 comprises a cylinder 112 held in the casing 44 by four insulating columns 114*a*~114*d* each comprising a synthetic resin tube (see also FIG. 3). One of the insulating columns 114*a* is of an elongate shape extending toward the coating gun 24. A piston 116 is axially movably disposed in the cylinder 112. An inner wall surface of the cylinder 112 and an axial end surface 120 of the piston 116 jointly define a cylinder chamber 118 to be filled with an electrically conductive paint, in the cylinder 112.

The axial end surface 120 of the piston 116 comprises a convexly tapered surface projecting toward a cap end wall 122 of the cylinder 112 remote from the piston 116. The cap end wall 122 has an inlet hole 124 defined in a peripheral edge portion thereof in communication with the paint supply passage 28*b*, and an outlet hole 126 defined axially centrally therein in communication with the coating gun 24. A plunger 128 is coaxially connected to the piston 116 and extends away from the cylinder 112. The plunger 128 houses a nut 130 in an axial end thereof remote from the piston 116. The nut 130 is threaded over a ball screw 136 which is coaxially connected to a rotatable shaft 134 of a servomotor 132. The ball screw 136 axially extends in the plunger 128 toward the piston 116, but terminates short of the piston 116.

The coating gun 24 has a circuit 140 for applying a high voltage (high-voltage applying means) which is electrically connected to a low-voltage cable 138 extending through the insulating column 114*a* and electrically connected to a power supply (not shown). As shown in FIG. 1, a third cleaning valve 144 communicates through a third cleaning passage 142 with a tip end portion of the coating gun 24. The third cleaning valve 144 serves to control the supply of water (W) and air (A).

Operation of the electrostatic coating apparatus 20 according to the first embodiment of the present invention will be described below.

For electrostatically coating a workpiece (not shown), the air cylinder 38 of the insulating separator valve mechanism 30 is operated to move the movable clock 36 to the left in FIG. 2 in the direction indicated by the arrow A1 as indicated by the two-dot-and-dash lines. The first valve body 52 is now coupled to the second valve body 96, whereupon their first and second communication holes 50, 98 are joined into the communication hole 104.

When a paint of a certain color is delivered under pressure from the paint valve 34*a* of the paint color changer valve mechanism 22, the paint is supplied from the paint supply passage 28*a* through the communication hole 104 to the paint supply passage 28*b*, with the first and second on/off valves 54, 100 being open. Therefore, the paint is filled in the cylinder chamber 118 through the inlet hole 124, and then in the coating gun 24 through the outlet hole 126.

The paint trap 105 which is defined in the first and second valve bodies 52, 96 that are coupled to each other, i.e., essentially the communication hole 104, is cleaned with the first and second on/off valves 54, 100 being closed. As shown in FIG. 1, the second directional control valve 110 is open, allowing water and air to be successively supplied from the second cleaning valve 94 through the second cleaning passage 108 to the second valve body 96. The water and air successively introduced into the second valve body 96 flow through the second communication hole 98 and the first communication hole 50 in the first valve body 52, washing away the residual paint left in the paint trap 105 (the communication hole 104) and drying the paint trap 105 (the communication hole 104). Thereafter, the water and air are discharged into the second dump passage 66 through the second dump valve 70 which is open, as indicated by the arrow X in FIG. 1.

According to the first embodiment, the paint trap 105 is cleaned and dried respectively by the water and air supplied from the second cleaning valve 94 while the first and second valve bodies 52, 96 are coupled to each other and the first and second on/off valves 54, 100 are closed. Any residual paint remaining in the paint trap 105 can quickly and reliably be removed, and hence no paint runs therefrom when the first valve body 52 is separated from the second valve body 96. Consequently, the electrostatic coating apparatus 20 is free from a leakage current under the high voltage and a mixture of different paint colors which would otherwise be caused by dried paint deposit if some residual paint were left in the paint trap 105.

Furthermore, the communication hole 104 (the paint trap 105) is cleaned and dried respectively by the water and air supplied from the second cleaning valve 94, and the water and air that have washed and dried the communication hole 104 are discharged from the second dump valve 70 to which no high voltage will be applied, into the second dump passage 66. Therefore, no current leakage occurs from the second dump valve 66 under the high voltage. The communication hole 104 (the paint trap 105) can be cleaned and dried in a shorter period of time and with a smaller amount of water and air than if a dump passage were connected to the second valve body 96 to which the high voltage will be applied.

Specifically, if the second dump passage 66 were connected to the second valve body 96 to which the high voltage will be applied, then it would be necessary to clean the second dump passage 66 highly thoroughly in order to prevent a leakage current from flowing under the high voltage due to a paint deposit applied to an inner wall surface of the second dump passage 66. However, since the second dump passage 66 is connected to the second dump valve 70 to which no high voltage will be applied in the first embodiment, no leakage current flows even when a paint deposit remains on an inner wall surface of the second dump passage 66. As a consequence, the second dump passage 66 is not essentially required to be cleaned.

While the paint trap 105 (the communication hole 104) provided by the coupled first and second valve bodies 52, 96 is being washed, the tip end of the coating gun 24 is cleaned and dried by the water and air supplied from the third cleaning valve 144 through the third cleaning passage 142.

Figure 6:
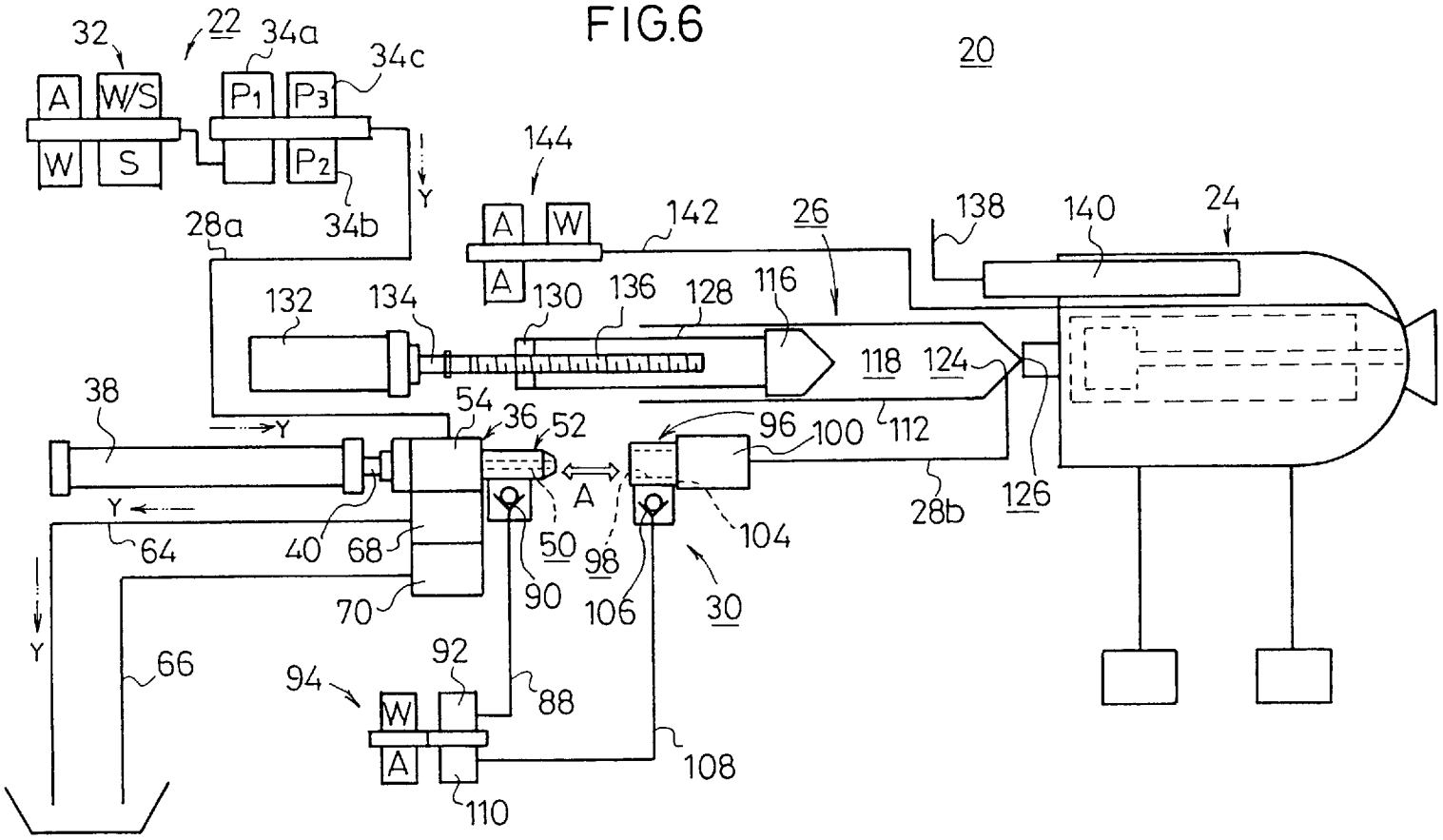
FIG. 6 is a schematic diagram of the electrostatic coating apparatus shown in FIG. 1, with first and second valve bodies separated from each other.

After the paint trap 105 (the communication hole 104) has been cleaned, the air cylinder 38 is operated to separate the first valve body 52 from the second valve body 96 with an insulating distance left therebetween (see the solid-line position in FIG. 2 and also FIG. 6). A cleaning process for a paint color change is carried out as follows: The paint supply passage 28*a* up to the first on/off valve 54 is cleaned and dried by water, a cleaning solution, and air supplied from the first cleaning valve 32, and the water, cleaning solution, and air which have cleaned and dried the paint supply passage 28*a* are discharged, together with any residual paint, into the first dump passage 64 through the first dump valve 68 which is open, as indicated by the arrow Y in FIG. 6. The paint color changer valve mechanism 22 is now capable of supplying a paint of a different color, and supplies a new paint from the paint valve 34*b*, for example, to the paint supply passage 28*a*, after which the paint color changer valve mechanism 22 is brought into a standby condition.

In the intermediate trap tank 26, the servomotor 132 is energized to rotate its shaft 134 and the ball screw 136 in unison. The plunger 128 and the piston 116 are now moved in the direction indicated by the arrow A1 in FIG. 2, by the nut 130 threaded over the ball screw 136. At the same time, the circuit 140 is energized to apply the high voltage to the coating gun 24 and also the paint, which is ejected from the coating gun 24 toward the non-illustrated workpiece.

After the coating of the paint filled in the cylinder chamber 118 in the intermediate trap tank 26 is finished, if a paint of a different color is thereafter to be applied to the workpiece, then the application of the high voltage to the coating gun 24 is stopped, and the air cylinder 38 is actuated to couple the first valve body 52 to the second valve body 96.

Then, the intermediate trap tank 26 to which the high voltage was applied is cleaned respectively by the water and air supplied from the second cleaning valve 94. Specifically, the servomotor 132 is energized to shift the piston 116 to a given position, and then, while the second on/off valve 100 is being open, water and air are supplied from the second cleaning valve 94 through the first directional control valve 92 and the first cleaning passage 88 and introduced into the paint supply passage 28*b*. The water and air are then introduced from the inlet hole 124 into the cylinder chamber 118 to clean and dry the cylinder chamber 118, and then flow from the outlet hole 126 into the coating gun 24, from which they are discharged as indicated by the arrow Z in FIG. 1.

In summary, according to the first embodiment, the electrostatic coating apparatus 20 is cleaned for a paint color change as follows: While the paint is being electrostatically applied to the workpiece under the high voltage applied to the coating gun 24 from the circuit 140 with the first and second valve bodies 52, 96 being separated from each other, the first cleaning valve 32 is operated to clean the paint supply passage 28*a* up to the first on/off valve 54, and then dried. Thereafter, a new paint is filled in the paint supply passage 28*a*. Accordingly, after the paint has been electrostatically applied to the workpiece, it is only necessary to clean and then dry the paint supply passage 28*b* and those passages connected thereto with water and air supplied from the second cleaning valve 94. As a result, the process of cleaning the electrostatic coating apparatus 20 for a paint color change is carried out very quickly and efficiently. The time required to clean the electrostatic coating apparatus 20 for a paint color change is much shorter than the time required to clean the conventional electrostatic coating apparatus because it has heretofore been necessary to clean the entire paint passages, ranging from the paint color changer valve mechanism to the coating gun, of the conventional electrostatic coating apparatus.

According to the first embodiment, furthermore, after the communication hole 104 (the paint trap 105) has been cleaned in a direction from the end to which the high voltage will be applied to the end to which no high voltage will be applied, the communication hole 104 (the paint trap 105) is supplied with water and air in a direction from the end to which no high voltage will be applied to the end to which the high voltage will be applied. Therefore, it is possible to prevent any paint from being left in the insulating separator valve mechanism 30 through a highly simple arrangement, and the insulating separator valve mechanism 30 is free from a leakage current under the high voltage and a mixture of different paint colors which would otherwise be caused by a dried paint deposit if some residual paint were left in the communication hole 104 (the paint trap 105).

Moreover, according to the first embodiment, as shown in FIG. 3, the movable block 36 is supported on the rail 42 by the retainers 48*a*, 48*b*, with the vertical gap H defined between the upper end surface 36*a* of the movable block 36 and the lower end surface 42*a* of the rail 42. Therefore, when the movable block 36 moves back and forth in the directions indicated by the arrows A, the upper end surface 36*a* of the movable block 36 and the lower end surface 42*a* of the rail 42 do not frictionally slide against each other, and hence particles which would otherwise be worn off those surfaces 36*a*, 42*a* do not enter the paint supply passage 28*b* from the second valve body 96.

In addition, according to the first embodiment, as shown in FIG. 2, the low-voltage cable 138 lies through the elongate insulating column 114*a* which extends to the coating gun 24. Therefore, when the high voltage is applied to the coating gun 24 by the circuit 140, the low-voltage cable 138 is prevented from acting as a ground body.

As shown in FIG. 4, the first and second dump passages 64, 66 are branched from the paint supply passage 28*a* near the valve seat 62 of the first on/off valve 54, and the first and second dump valves 68, 70 are positioned as closely to the first on/off valve 54 as possible. Therefore, any paint residual that may remain unremoved by the cleaning process is minimized, and any wasted amount of paint is greatly reduced.

An electrostatic coating apparatus 210 according to a second embodiment of the present invention will be described below with reference to FIGS. 7 through 14.

Figure 7:
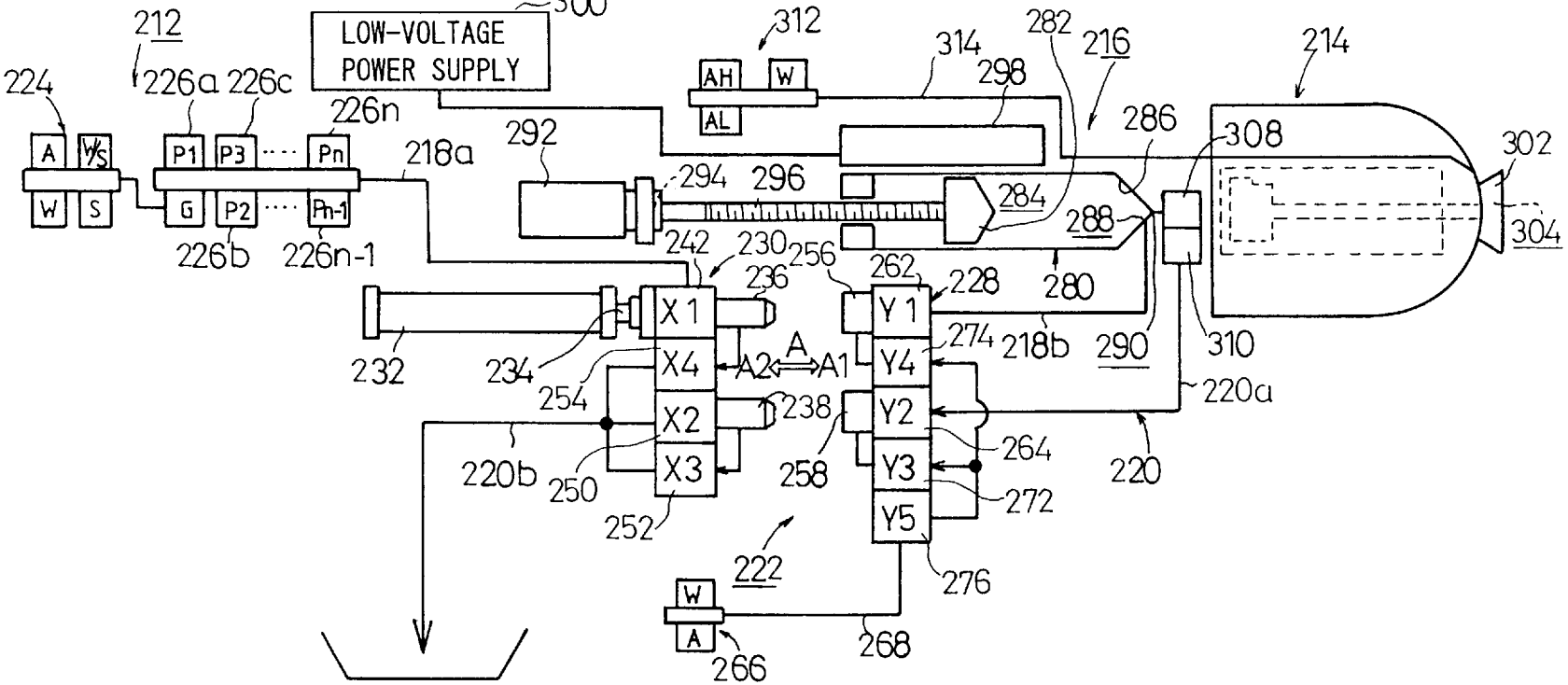
FIG. 7 is a schematic diagram of an electrostatic coating apparatus according to a second embodiment of the present invention.

As shown in FIG. 7, the electrostatic coating apparatus 210 comprises a grounded paint color changer valve mechanism 212 for selectively supplying a plurality of electrically conductive paints of different colors, a coating gun 214 for ejecting a supplied paint toward a workpiece, an intermediate paint trap tank 216 interposed between the paint color changer valve mechanism 212 and the coating gun 214, and an insulating separator valve mechanism 222 for disconnectably connecting paint supply passages 218*a*, 218*b* extending between the paint color changer valve mechanism 212 and the intermediate paint trap tank 216, and also for selectively separating mechanically and electrically a dump passage 220 branched from the coating gun 214 into a first dump passage 220*a* to which a high voltage will be applied and a second dump passage 220*b*.

The paint color changer valve mechanism 212 has a first cleaning valve 224 for controlling the supply of water (W), a cleaning solution (S), and air (A), and a plurality of paint valves 226*a*~226*n* for supplying different paints (P1~Pn), respectively.

The insulating separator valve mechanism 222 has a fixed block (first connector) 228 connected to an intermediate paint trap tank 216 through a paint supply passage 218*b* to which a high voltage will be applied, and a movable block (second connector) 230 connected to the paint color changer valve mechanism 212 through a paint supply passage 218*a* to which no high voltage is applied. The movable block 230 is connected to a rod 234 extending from an air cylinder 232 (actuating means) for movement in the directions indicated by the arrow A.

Figure 8:
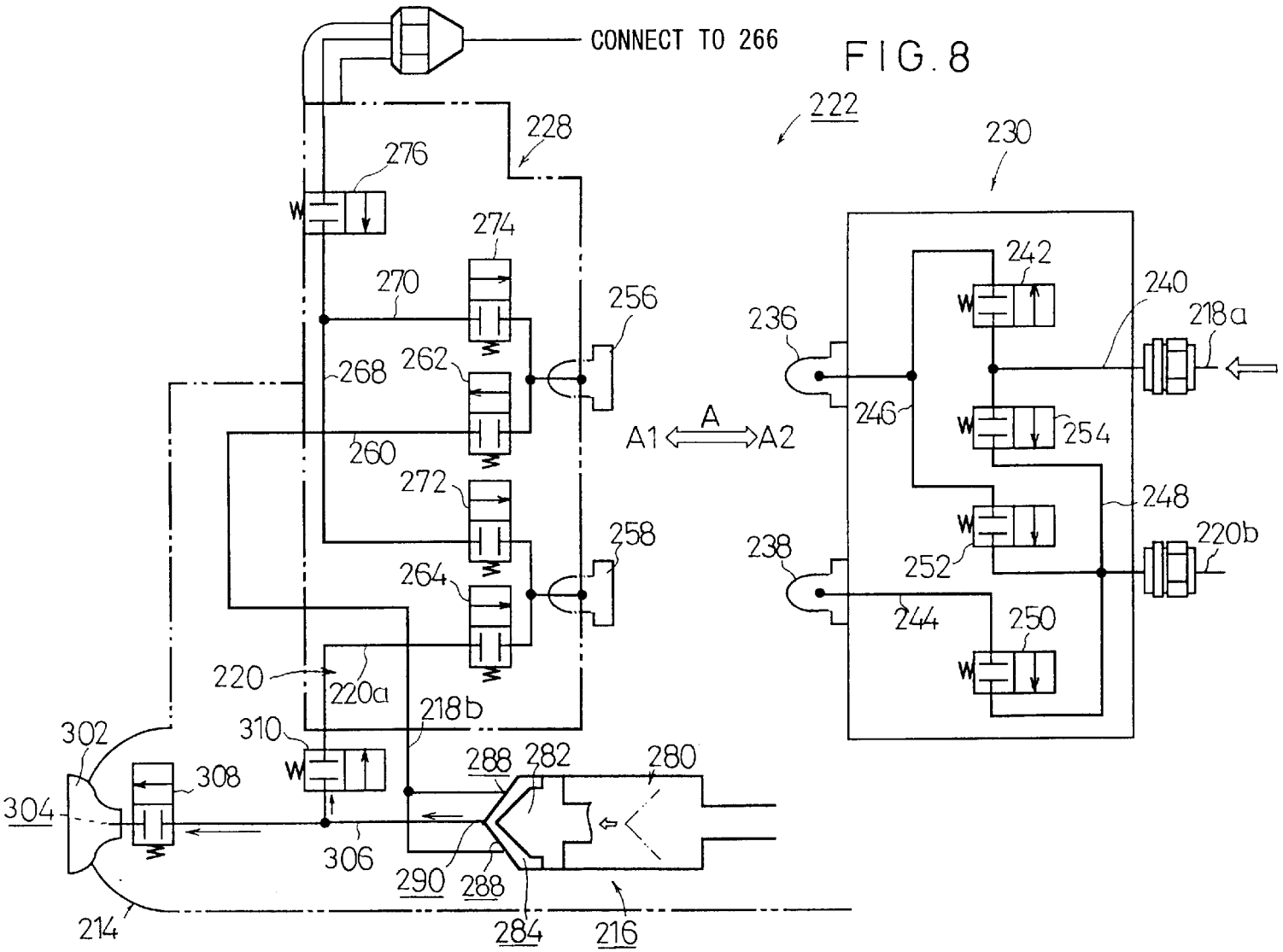
FIG. 8 is a circuit diagram of the electrostatic coating apparatus shown in FIG. 7.

The movable block 230 has first and second male valve bodies 236, 238. As shown in FIG. 8, the first male valve body 236 has a first communication hole 240 defined therein in communication with the paint supply passage 218*a* and having an X1 on/off valve (fifth on/off valve) 242. The second male valve body 238 has a first cleaning passage 244 defined therein which is joined to second and third cleaning passages 246, 248 branched from the first communication hole 240 and communicates with the second dump passage 220*b*. The first, second, and third cleaning passages 244, 246, 248 have respectively an X2 on/off valve (second on/off valve) 250, an X3 on/off valve (second on/off valve) 252, and an X4 on/off valve 254.

The fixed block 228 has first and second female valve bodies 256, 258. As shown in FIG. 8, the first female valve body 256 has a second communication hole 260 defined therein in communication with the paint supply passage 218*b* and having a Y1 on/off valve (fourth on/off valve) 262. The second female valve body 258 has the first dump passage 220*a* defined therein which has a Y2 on/off valve (first on/off valve) 264.

A first branch passage 268 coupled to a second cleaning valve 266 which supplies water (W) and air (A) is connected downstream of the Y2 on/off valve 264, and a second branch passage 270 is branched from the first branch passage 268 in communication with the first female valve body 256. The first and second branch passages 268, 270 have a Y3 on/off valve (third on/off valve) 272, a Y4 on/off valve (third on/off valve) 274, and a Y5 on/off valve 276 for connecting the second cleaning valve 266 to the second dump passage 220*b* when the first and second male valve bodies 236, 238 are connected respectively to the first and second female valve bodies 256, 258.

As shown in FIG. 7, the intermediate paint trap tank 216 has a cylinder 280 and a piston 282 disposed in the cylinder 280 for reciprocating movement in the directions indicated by the arrow A. An inner wall surface of the cylinder 280 and an axial end surface of the piston 282 jointly define a cylinder chamber 284 to be filled with a paint, in the cylinder 280. A cap end wall 286 of the cylinder 280 has an inlet hole 288 defined in a peripheral edge portion thereof in communication with the paint supply passage 218*b*, and an outlet hole 290 defined axially centrally therein in communication with the coating gun 214.

To the piston 282, there is coaxially connected a ball screw 296 coupled to a rotatable shaft 294 of a servomotor 292. A high-voltage generator 298 is disposed near the cylinder 280 and electrically connected to a low-voltage power supply 300.

As shown in FIG. 8, the coating gun 214 has a paint supply passage 306 extending from the outlet hole 290 of the cylinder 280 to a paint discharge port 304 of a rotary atomizing head 302 through a trigger valve 308. The dump passage 220 is branched from the paint supply passage 306 through a dump valve 310.

As shown in FIG. 7, a third cleaning valve 312 for supplying water (W) and air (A) to clean and dry the rotary atomizing head 302 is connected to a cleaning passage 314 which is connected to the coating gun 214.

The electrostatic coating apparatus 210 according to the second embodiment will operate as follows:

To change paints of different colors, the paint supply passage 218*a* to which no voltage is applied is cleaned while the existing paint filled in the intermediate paint trap tank 216 is being ejected from the coating gun 214 under a high voltage applied thereto for electrostatically coating a workpiece (not shown).

Specifically, the paint supply passage 218*a* up to the movable block 230 is cleaned and dried by water, a cleaning solution, and air supplied from the first cleaning valve 224. The water, cleaning solution, and air which have cleaned and dried the paint supply passage 218*a*, and any residual paint are discharged as a drain solution into the second dump passage 220*b* through the X4 on/off valve 254 which is open. Then, the X4 on/off valve 254 is closed, and a new paint is supplied from any one of the paint valves 226*a*~226*n* to the cleaned paint supply passage 218*a* (see FIG. 8).

Figure 9:
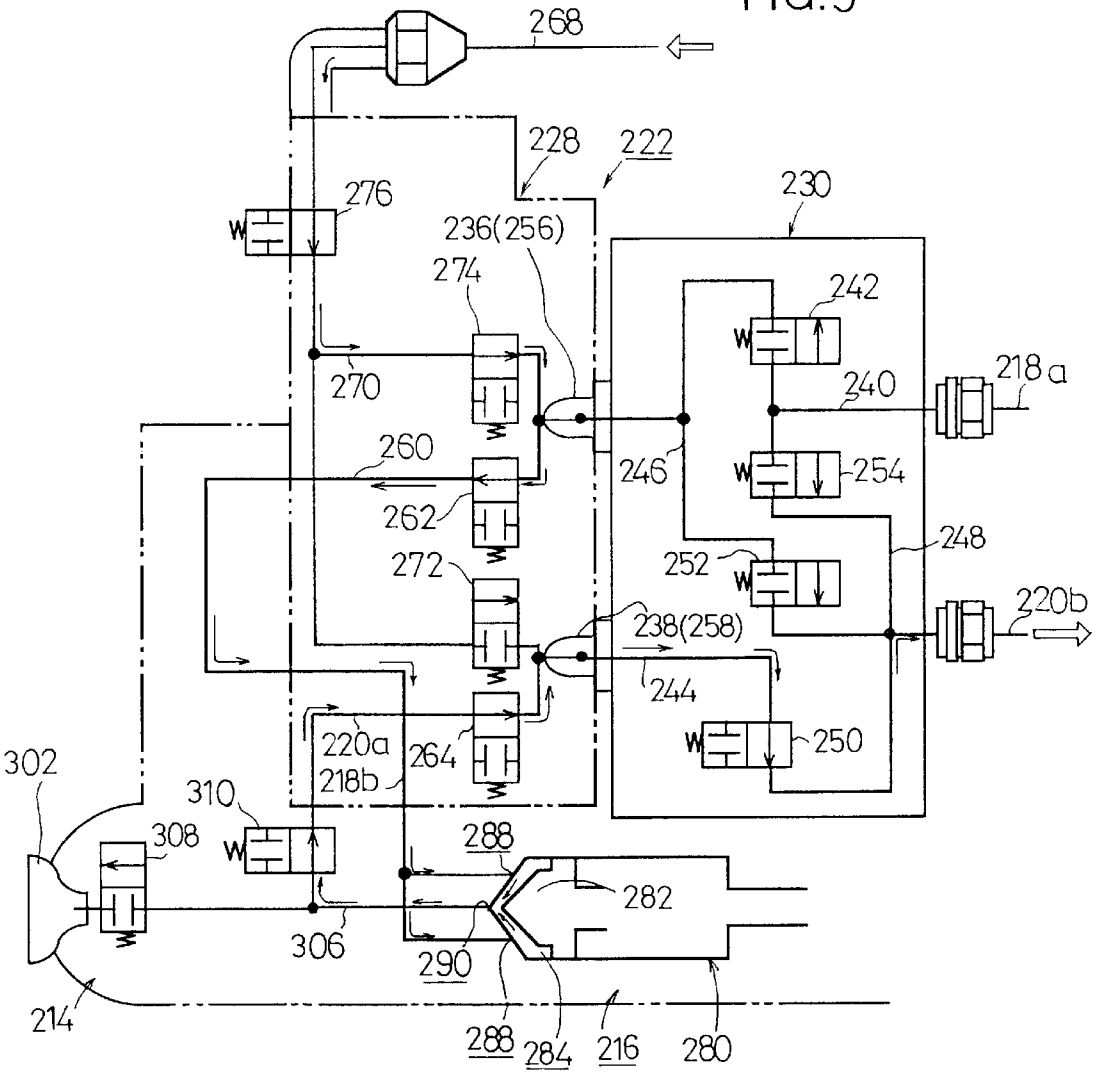
FIG. 9 is a circuit diagram of the electrostatic coating apparatus shown in FIG. 7, showing a circuit arrangement for cleaning passages to which a high voltage will be applied.

Thereafter, the electrostatic coating of the paint of the previous color is stopped, and the air cylinder 232 is operated to move the movable block 230 in the direction indicated by the arrow A1 (see FIGS. 7 and 8) until the first and second male valve bodies 236, 238 are connected respectively to the first and second female valve bodies 256, 258. As shown in FIG. 9, the X2 on/off valve 250, the Y1 on/off valve 262, the Y2 on/off valve 264, the Y4 on/off valve 274, the Y5 on/off valve 276, and the dump valve 310 are opened. At this time, the first dump passage 220*a* and the second dump passage 220*b* communicate with each other through the junction between the second male and female valve bodies 238, 258.

Water and air are then supplied from the second cleaning valve 266 through the first branch passage 268, the second branch passage 270, and the second communication hole 260 to the paint supply passage 218*b*. The water and air thus supplied are introduced through the inlet hole 288 into the cylinder chamber 284 to clean and dry the cylinder chamber 284, and are thereafter introduced from the outlet hole 290 into the coating gun 214. The water and air are delivered from the supply passage 306 to the first dump passage 220*a*, flow through the junction between the second male and female valve bodies 238, 258 and the first cleaning passage 244, and are discharged into the second dump passage 220*b*. The trigger valve 308 is opened to clean the paint supply passage 306 in its entirety which leads to the paint discharge port 304 of the rotary atomizing head 302.

Consequently, any remaining paint of the previous color is washed out of the passages ranging from the fixed block 228 to which the high voltage was applied, to the coating gun 214.

Figure 10:
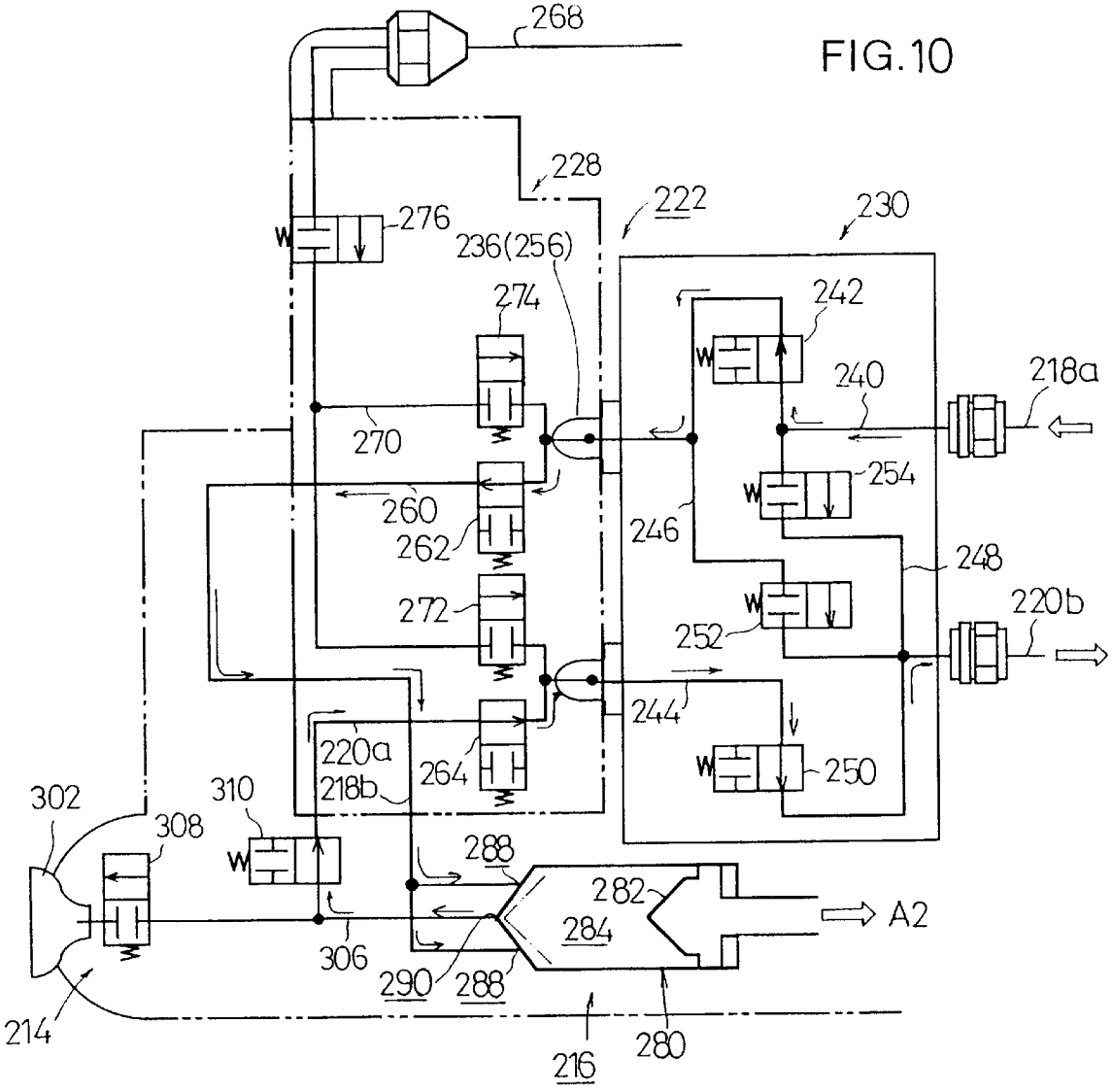
FIG. 10 is a circuit diagram of the electrostatic coating apparatus shown in FIG. 7, showing a circuit arrangement for removing air from passages for filling with a paint of a different color.

Then, as shown in FIG. 10, the X1 on/off valve 242, the X2 on/off valve 250, the Y1 on/off valve 262, the Y2 on/off valve 264, and the dump valve 310 are opened. At this time, the paint supply passages 218*a*, 218*b* communicate with each other, and the first dump passage 220*a* and the second dump passage 220*b* communicate with each other through the junction between the second male and female valve bodies 238, 258. The new paint of the next color which has been supplied to the paint supply passage 218*a* flows through the first communication hole 240 and the second communication hole 260 into the paint supply passage 218*b*, from which the paint is introduced through the inlet hole 288 into the cylinder chamber 284. The paint thus flows through the outlet hole 290 into the paint supply passage 306, and is delivered from the paint supply passage 306 into the first dump passage 220*a* and the second dump passage 220*b*, expelling any remaining air from these passages.

Thereafter, the Y2 on/off valve 264 and the dump valve 310 are closed, and the servomotor 292 is energized to move the ball screw 296 and the piston 282 in unison in the direction indicated by the arrow A2 from the two-dot-and-dash-line position to the solid-line position in FIG. 10. The cylinder chamber 284 is now filled with the new paint of the next color supplied from the paint supply passage 281*b*.

After the new paint of the next color has been filled in the intermediate paint trap tank 216, the junctions between the first and second male valve bodies 236, 238 and the first and second female valve bodies 256, 258, which are the junction between the fixed block 228 and the movable block 230, are cleaned. Specifically, as shown in FIG. 11, the X2 on/off valve 250, the X3 on/off valve 252, the Y3 on/off valve 272, the Y4 on/off valve 274, and the Y5 on/off valve 276 are opened, allowing water and air to be successively supplied from the second cleaning valve 266 into the first branch passage 268 and the second branch passage 270.

The water and air that are supplied to the second branch passage 270 clean and dry the junction between the first male valve body 236 and the first female valve body 256, and are then discharged from the second cleaning passage 246 into the second dump passage 220*b*. The water and air that are supplied to the first branch passage 268 clean and dry the junction between the second male valve body 238 and the second female valve body 258, and are then discharged from the first cleaning passage 244 into the second dump passage 220*b*.

Figure 11:
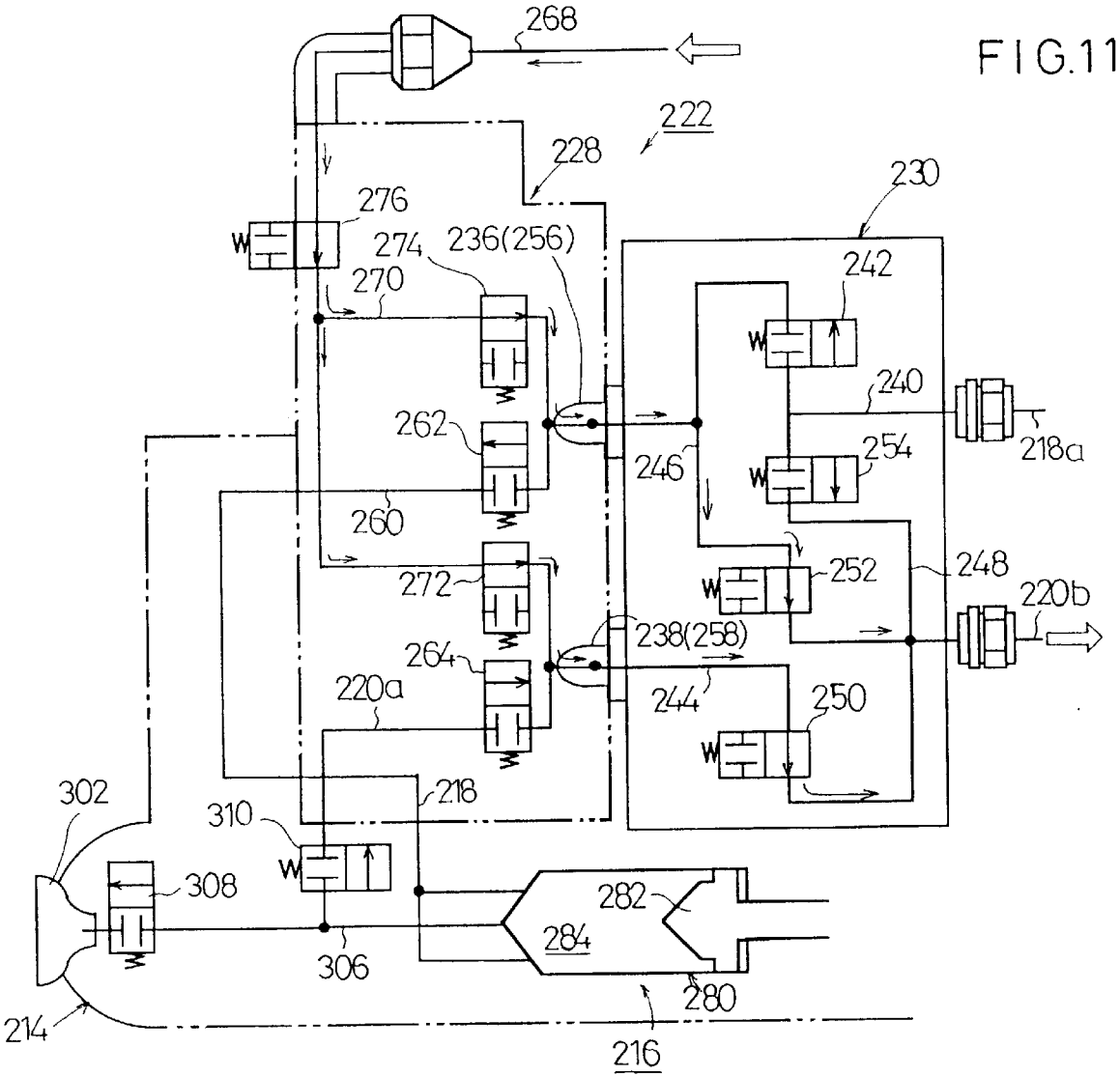
FIG. 11 is a circuit diagram of the electrostatic coating apparatus shown in FIG. 7, showing a circuit arrangement for cleaning junctions between male and female valve bodies.

After the insulating separator valve mechanism 222 has been cleaned, all the on/off valves except the X2 on/off valve 250, which have been opened as shown in FIG. 11, are closed. The air cylinder 232 is operated to move the movable block 230 in the direction indicated by the arrow A2, separating the movable block 230 away from the fixed block 228 with an insulating distance left therebetween (see FIGS. 7 and 12).

Figure 12:
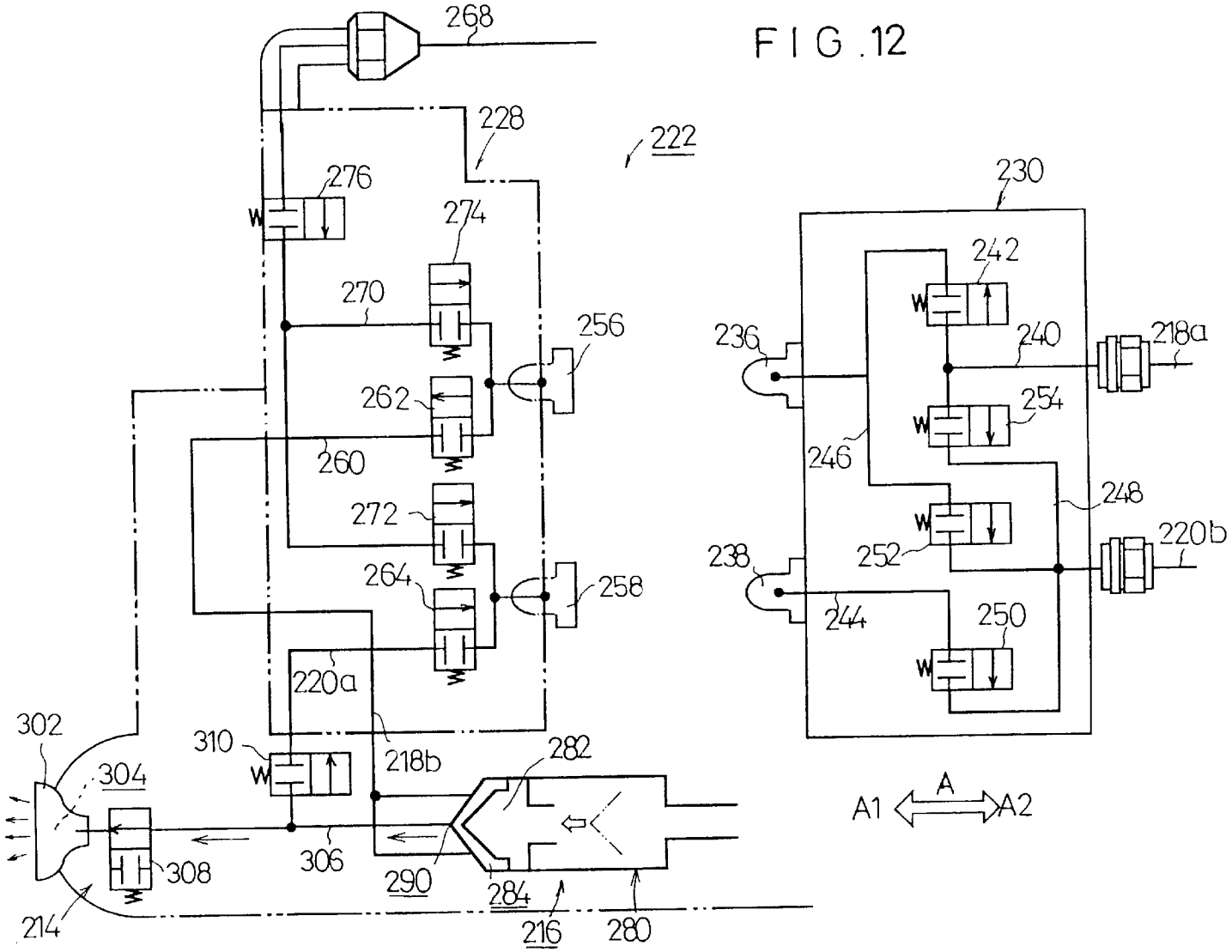
FIG. 12 is a circuit diagram of the electrostatic coating apparatus shown in FIG. 7, showing a circuit arrangement for electrostatically coating a workpiece.

Then, the low-voltage power supply 300 is energized to apply a low voltage to the high-voltage generator 298 which applies a high voltage to the paint filled in the cylinder chamber 284. As shown in FIG. 12, the servomotor 292 is energized and the trigger valve 308 is opened. The paint in the cylinder chamber 284 is forced from the outlet hole 290 through the paint supply passage 306. Since the trigger valve 308 is open, the paint is ejected from the paint discharge port 304 of the rotary atomizing head 302 to electrostatically coat the non-illustrated workpiece.

In the second embodiment, as described above, after the paint of the next color has been introduced through the paint supply passages 218*a*, 218*b* into the intermediate paint trap tank 216, the junctions between the first and second male valve bodies 236, 238 and the first and second female valve bodies 256, 258 are cleaned and dried by the water and air supplied from the second cleaning valve 266 (see FIG. 11).

Therefore, as shown in FIG. 12, when the movable block 230 is separated and moved away from the fixed block 228 for electrostatically coating the workpiece with the paint of the next color, no residual paint runs down from the junctions between the first and second male valve bodies 236, 238 and the first and second female valve bodies 256, 258. Therefore, no current leakage occurs under the high voltage when the workpiece is electrostatically coated with the paint of the next color. Since no paint is deposited on the junctions between the first and second male valve bodies 236, 238 and the first and second female valve bodies 256, 258, the sealing capability of those junctions is not lowered, i.e., the junctions can maintain a desired level of sealing capability.

Figure 13:
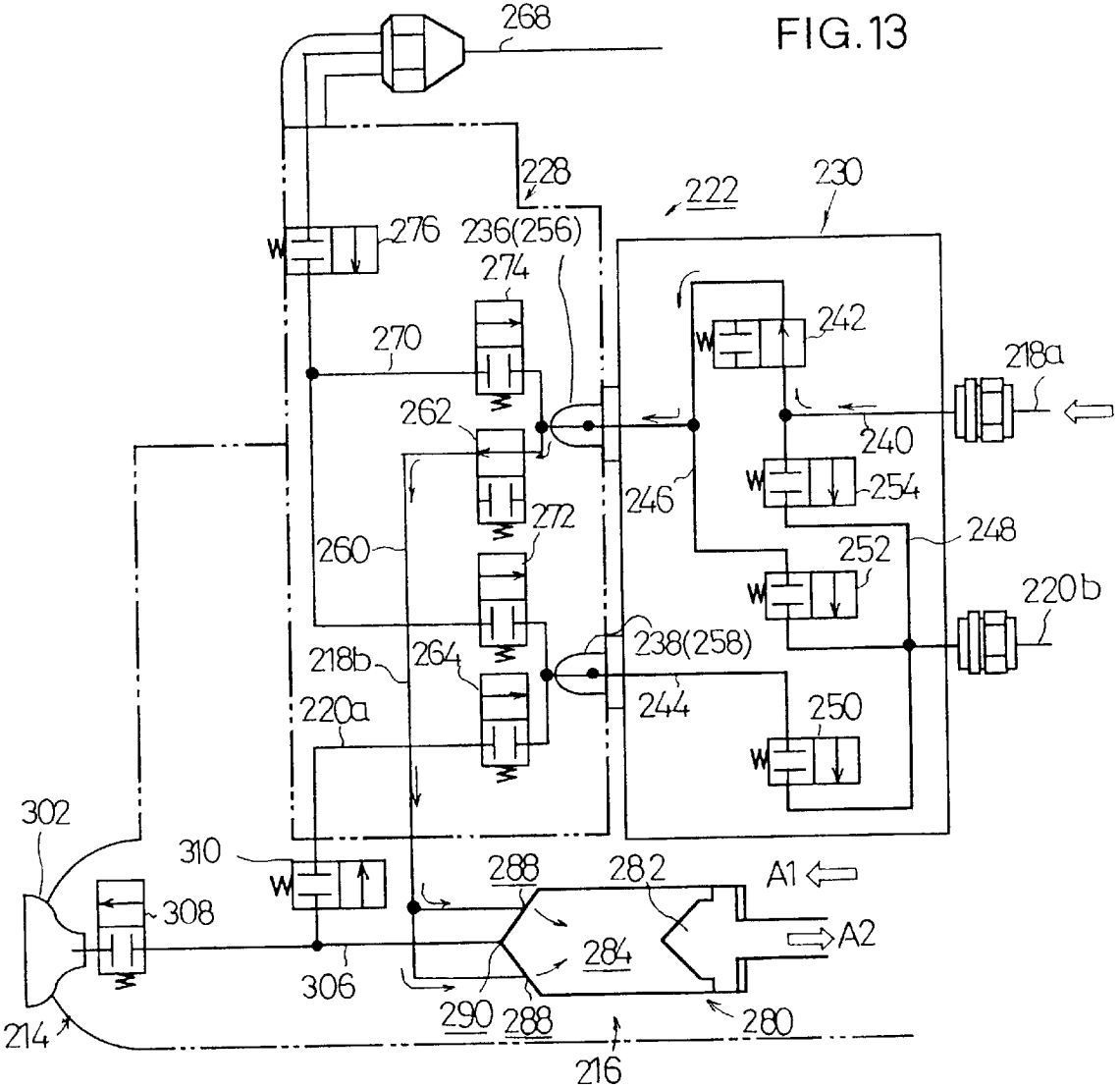
FIG. 13 is a circuit diagram of the electrostatic coating apparatus shown in FIG. 7, showing a circuit arrangement for filling with a paint of the same color.

For electrostatically coating the workpiece with a paint of the same color, after the coating process performed in the position shown in FIG. 12, the air cylinder 232 is operated to move the movable block 230 in the direction indicated by the arrow A1 until the movable block 230 is joined to the fixed block 228, as shown in FIG. 13. The trigger valve 308 is closed, the X1 on/off valve 242 and the Y1 on/off valve 262 are opened, and the servomotor 292 is energized to move the piston 282 in the direction indicated by the arrow A2. Now, the intermediate paint trap tank 216 is filled with the paint of the same color through the paint supply passage 218*a*, the first and second communication holes 240, 260, and the paint supply passage 218*b*.

Figure 14:
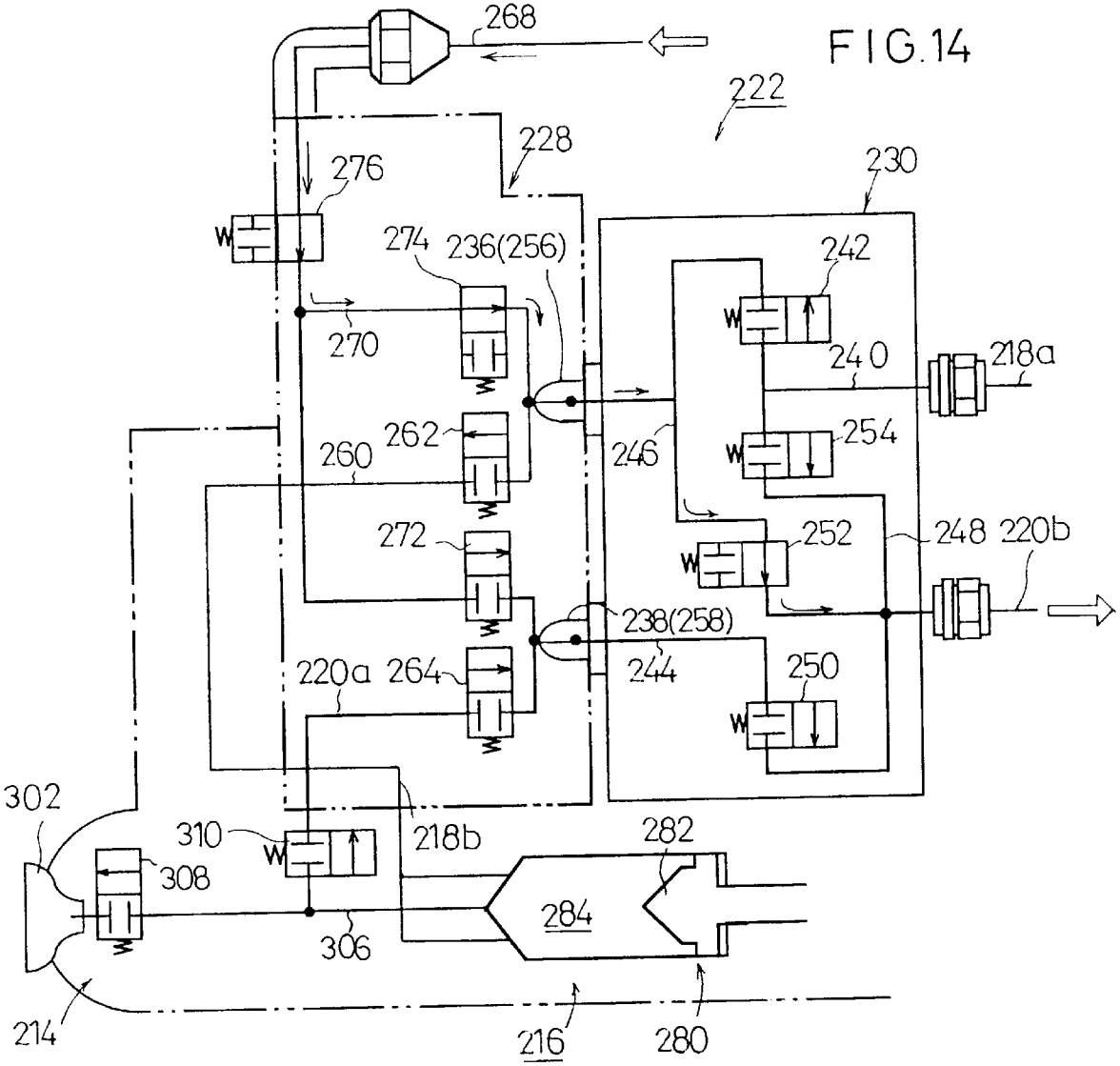
FIG.14 is a circuit diagram of the electrostatic coating apparatus shown in FIG. 7, showing a circuit arrangement for cleaning one of the junctions between male and female valve bodies.

After the intermediate paint trap tank 216 has been filled with the paint of the same color, the X1 on/off valve 242 and the Y1 on/off valve 262 are closed, and the X3 on/off valve 252, the Y4 on/off valve 274, and the Y5 on/off valve 276 are opened, as shown in FIG. 14. Water and air are successively supplied from the second cleaning valve 266 through the first branch passage 268 into the second branch passage 270, cleaning and drying the junction between the first male valve body 236 and the first female valve body 256 through which the paint has passed. The water and air which have cleaned and dried the junction between the first male valve body 236 and the first female valve body 256 are then discharged through the second cleaning passage 246 into the second dump passage 220*b*.

The X3 on/off valve 252, the Y4 on/off valve 274, and the Y5 on/off valve 276 are closed, after which the movable block 230 is spaced away from the fixed block 228 by the air cylinder 232. Then, the trigger valve 308 is opened to enable the coating gun 214 to electrostatically coat the workpiece with the paint of the same color, as shown in FIG. 12.

In the second embodiment, for electrostatically coating the workpiece with the paint of the same color, the paint is supplied from the paint supply passage 218*a* into the intermediate paint trap tank 216, and thereafter the junction between the first male valve body 236 and the first female valve body 256 through which the paint has passed is cleaned and dried. Therefore, no paint remains left in the junction. When the movable block 230 is separated from the fixed block 228, no paint runs from the junctions, and hence no current leakage occurs under the high voltage during the coating process. Furthermore, the sealing capability of the junctions is not impaired by residual paint deposits which would otherwise remain in the junctions. Accordingly, the workpiece can be efficiently coated with a high-quality coating layer by a relatively simple arrangement.

An electrostatic coating apparatus 320 according to a third embodiment of the present invention will be described below with reference to FIGS. 15 through 18. Those parts of the electrostatic coating apparatus 320 which are identical to those of the electrostatic coating apparatus 210 according to the second embodiment are denoted by identical reference characters, and will not be described in detail below.

Figure 15:
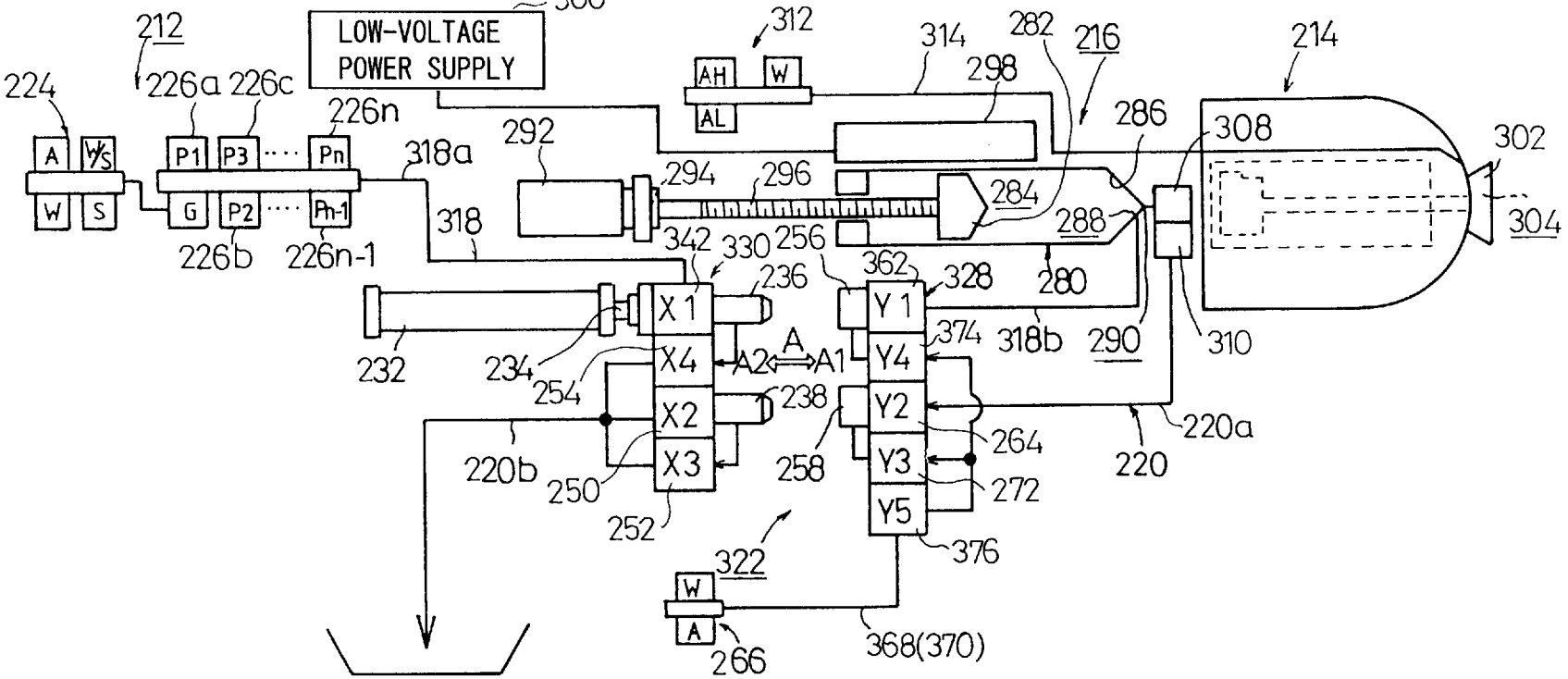
FIG. 15 is a schematic diagram of an electrostatic coating apparatus according to a third embodiment of the present invention.

As shown in FIG. 15, the electrostatic coating apparatus 320 has an insulating separator valve mechanism 322 for selectively separating mechanically and electrically a paint supply passage 318 for supplying an electrically conductive paint to the coating gun 214 into a first paint supply passage 318*a* connected to the grounded paint color changer valve mechanism (paint supply source) 212 and a second paint supply passage 318*b* to which a high voltage will be applied.

The insulating separator valve mechanism 322 comprises a movable block (first connector) 330 having an X1 on/off valve (first on/off valve) 342 connected to the first paint supply passage 318*a*, and a fixed block (second connector) 328 having a Y1 on/off valve (second on/off valve) 362 connected to the second paint supply passage 318*b* and also having first and second branch passages 368, 370 disposed upstream of the Y1 on/off valve 362 and connected to the second cleaning valve (cleaning medium supply source) 266. To the first and second branch passages 368, 370, there are connected a Y4 on/off valve (third on/off valve) 374 which can be opened and a Y4 on/off valve (fourth on/off valve) 376 which can be closed in order to expel air trapped in the junctions between the movable and fixed blocks 330, 328 into a portion of the first and second branch passages 368, 370 under the pressure of an electrically conductive paint supplied from the first paint supply passage 318*a*, when the movable and fixed blocks 330, 328 are joined to each other and the Y1 on/off valve 362 is closed.

The electrostatic coating apparatus 320 according to the third embodiment operates as follows: Details of the operation of the electrostatic coating apparatus 320 which are identical to those of the electrostatic coating apparatus 210 according to the second embodiment will not be described below, whereas only details of the operation which are unique to the electrostatic coating apparatus 320 according to the third embodiment will be described below.

Figure 16:
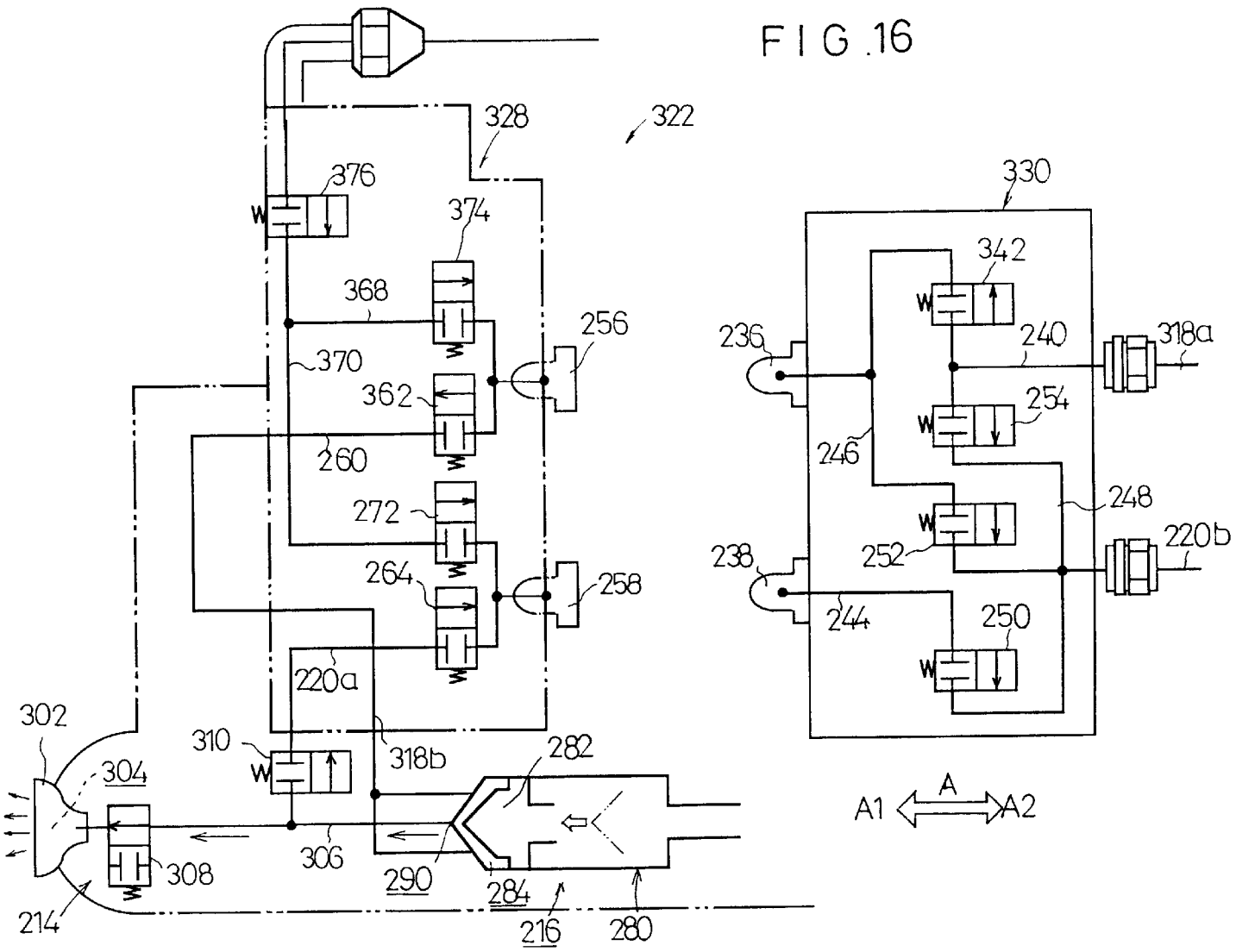
FIG. 16 is a circuit diagram of the electrostatic coating apparatus shown in FIG. 15, showing a circuit arrangement for electrostatically coating a workpiece.

For electrostatically coating a workpiece with a paint of the same color, after the workpiece has been coated in the position shown in FIG. 16, the air cylinder 232 is operated to move the movable block 330 in the direction indicated by the arrow A1 until the movable block 330 is joined to the fixed block 328. At this time, air tends to be trapped in the junction between the first male valve body 236 and the first female valve body 256 as they are coupled to each other.

Figure 17:
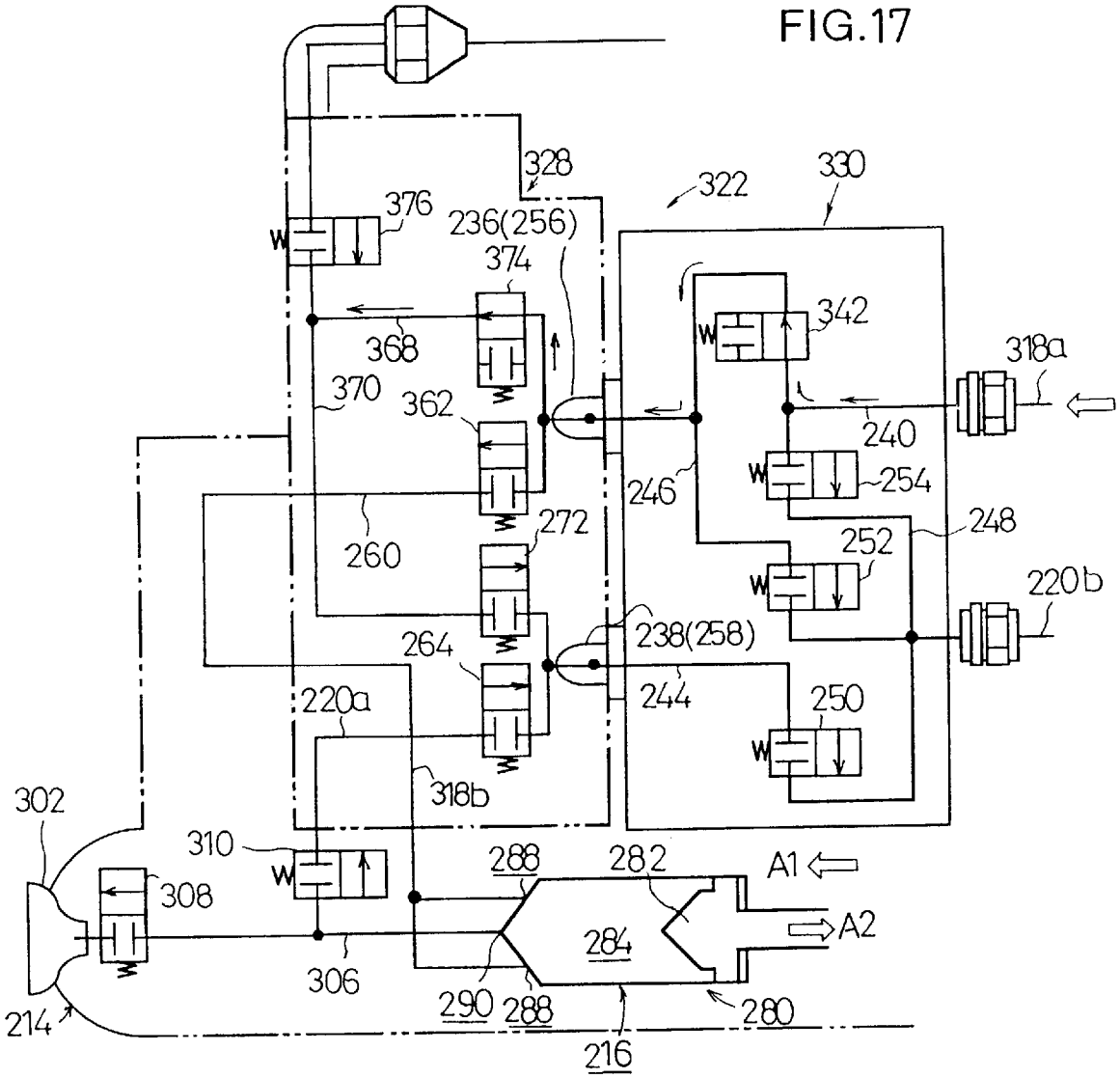
FIG. 17 is a circuit diagram of the electrostatic coating apparatus shown in FIG. 15, showing a circuit arrangement for forcing air trapped in a junction between first and second paint supply passages into a branch passage.

According to the third embodiment, as shown in FIG. 17, the trigger valve 308 is closed, the Y1 on/off valve 362 is closed, the Y4 on/off valve 374 is opened, and the Y5 on/off valve 376 is closed. The X1 on/off valve 342 is opened to introduce the paint delivered from the paint supply source 212 from the Y4 on/off valve 374 into a portion of the first branch passage 368 and the second branch passage 370, prior to being supplied to the second paint supply passage 318*b*.

Therefore, under the pressure of the paint delivered from the first paint supply passage 318*a*, any air trapped in the junction between the first male valve body 236 and the first female valve body 256 is expelled into the portion of the first branch passage 368 between the Y4 on/off valve 374 and the Y5 on/off valve 376.

Figure 18:
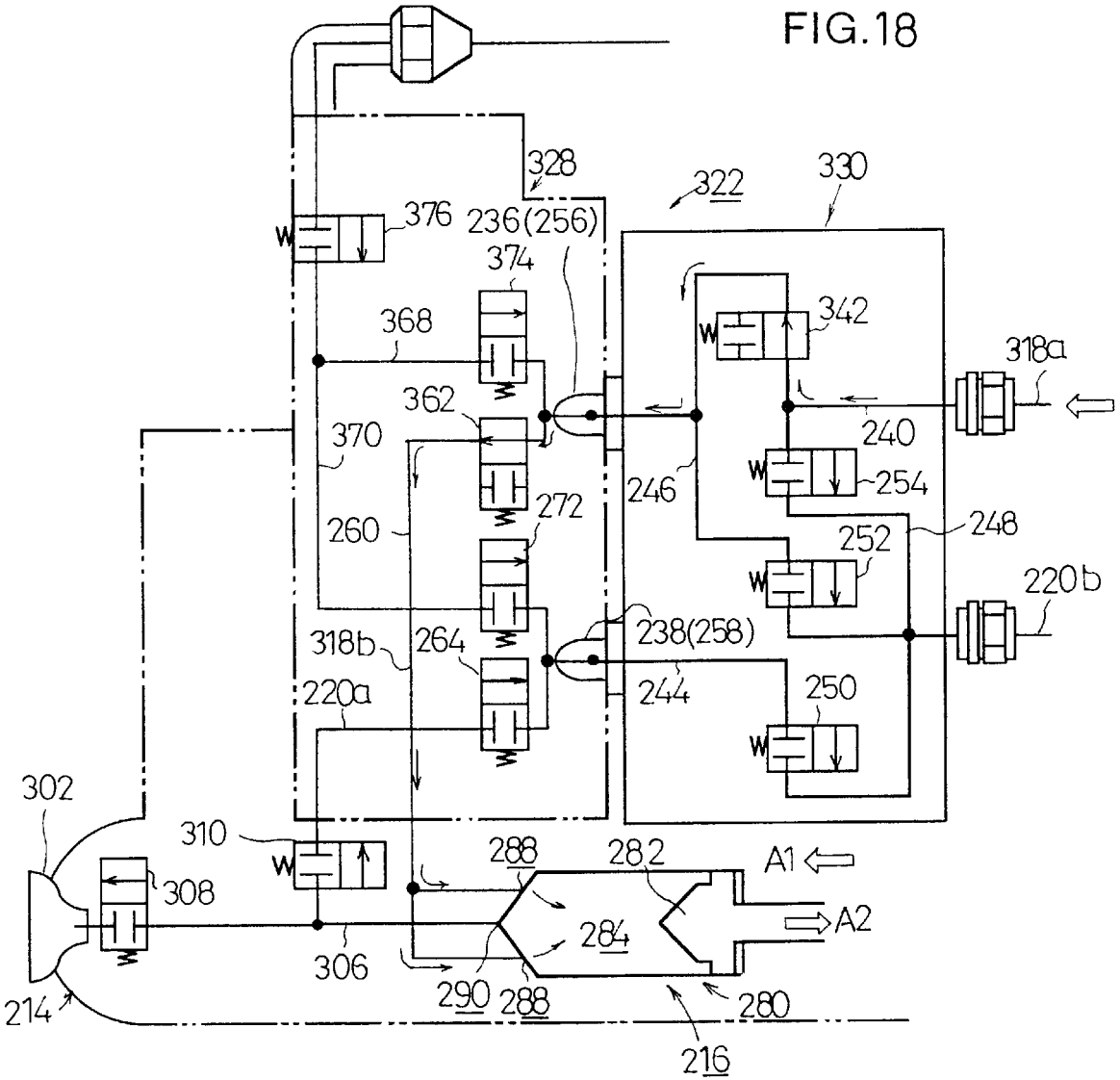
FIG. 18 is a circuit diagram of the electrostatic coating apparatus shown in FIG. 15, showing a circuit arrangement for filling with a paint of the same color.
Figure 19:
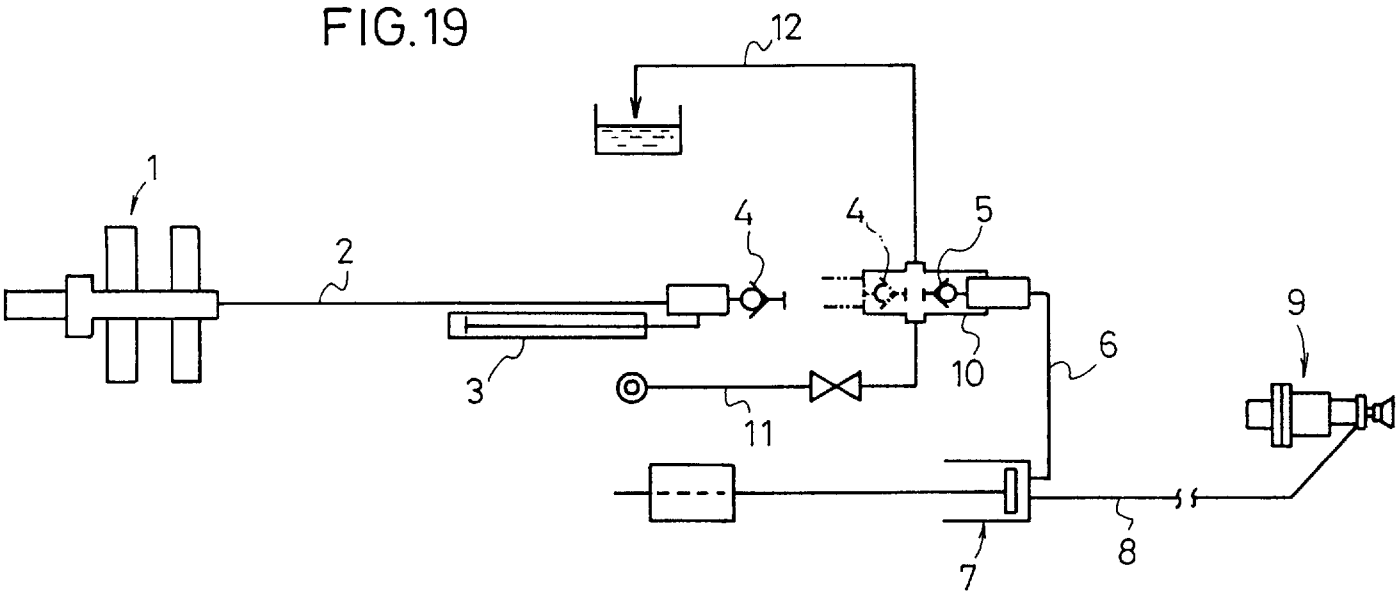
FIG. 19 is a schematic diagram of a conventional electrostatic coating apparatus.

As shown in FIG. 18, the Y4 on/off valve 374 is closed, the X1 on/off valve 342 and the Y1 on/off valve 362 are opened, and the servomotor 292 is energized to move the piston 282 in the direction indicated by the arrow A2. The intermediate paint trap tank 216 is now filled with the paint, free of trapped air, through the first and second paint supply passages 318*a*, 318*b*.

According to the third embodiment, therefore, when the trigger valve 308 is opened, enabling the coating gun 214 to electrostatically coat the workpiece with the paint, as shown in FIG. 16, since no air is trapped in the paint filled in the intermediate paint trap tank 216, any air bubbles are reliably prevented from being contained in the coating layer formed on the workpiece. Accordingly, the workpiece can be efficiently coated with a high-quality coating layer by a relatively simple arrangement.

In the illustrated third embodiment, air trapped in the junction between the first male valve body 236 and the first female valve body 256 is expelled into the portion of the first branch passage 368 between the Y4 on/off valve 374 and the Y5 on/off valve 376. However, three or more on/off valves may be employed to define a passage portion into which trapped air can be expelled.

In the electrostatic coating apparatus according to the present invention, while the high voltage is being applied to the coating gun to electrostatically coat the workpiece with the paint ejected from the coating gun, the paint supply passage from the paint supply source up to the first valve body can be cleaned and washed efficiently and quickly for a paint color change. The paint trap is cleaned by the cleaning valve while the first and second valve bodies are joined to each other and the first and second on/off valves are closed. It is therefore possible to remove a residual paint reliably and effectively, preventing a leakage current under the high voltage and a mixture of different paint colors which would otherwise be caused by a dried paint deposit.

In the electrostatic coating apparatus according to the present invention, furthermore, the dump passage is disposed in the vicinity of the first valve body to which no high voltage will be applied, and the cleaning medium supplied from the cleaning liquid supply passage of the second valve body to which a high voltage will be applied into the communication hole is discharged into the dump passage. Therefore, no current leakage occurs from the dump passage, and the communication passage is efficiently cleaned in a short period of time with a small amount of cleaning liquid.

In the electrostatic coating method and apparatus according to the present invention, while the first and second dump passages are connected to each other, the junction between the first and second dump passages is cleaned by the cleaning medium from the cleaning medium supply source. The junction between the first and second dump passages which are disconnectably connectable is thus kept clean at all times. Any paint deposits are reliably prevented from being left in the junction through a relatively simple arrangement, and the sealing capability of the junction is effectively maintained. No drain liquid including the paint runs from the junction, so that leaking currents are effectively prevented from being produced under the high voltage.

In the electrostatic coating method and apparatus according to the present invention, furthermore, any air trapped between the junction between the first and second paint supply passages is expelled into the portion of the branch passage between the third and fourth on/off valves under the pressure of the electrically conductive paint supplied from the paint supply source, and thereafter the electrically conductive paint, free of any trapped air, is supplied to the coating gun. Any air bubbles are, therefore, reliably prevented from being contained in the coating layer formed on the workpiece. Accordingly, the workpiece can be efficiently coated with a high-quality coating layer by a relatively simple arrangement.

Although certain preferred embodiments of the present invention have been shown and described in detail, it should be understood that various changes and modifications may be made therein without departing from the scope of the appended claims.

What is claimed is:

1. An apparatus for electrostatically coating a workpiece, comprising:

a coating gun to which a high voltage will be applied; and an insulating separator valve mechanism for electrically separating a paint supply passage for supplying an electrically conductive paint to said coating gun into a first paint supply passage to which a high voltage will be applied and a second paint supply passage to which no high voltage will be applied, said insulating separator valve mechanism comprising:

a first valve body connectable to said first paint supply passage through a first on/off valve;

a second valve body connectable to said second paint supply passage through a second on/off valve; and actuating means for detachably connecting said first valve body and said second valve body to each other, wherein said apparatus further comprises:

a first dump passage branched from said first paint supply passage near said first valve body;

a first dump valve for opening and closing said first dump passage;

a paint trap defined by said by first valve body and said second valve body when said first valve body and second valve body are joined to each other and both of said first on/off valve and said second on/off valve are off; and cleaning means for cleaning said paint trap while said first valve body and said second valve body are joined to each other and both of said first on/off valve and said second on/off valve are off.

2. An apparatus according to claim 1, further comprising:

second dump passage communicating with said paint trap near said first valve body;

a second dump valve for opening and closing said dump passage, wherein said cleaning means has a cleaning medium supply passage disposed near said second valve body for cleaning said paint trap through a valve.

3. An apparatus according to claim 1, further comprising:

a movable block comprising said first valve body; and a rail having a substantially arch-shaped cross section, said movable block being movably supported on said rail, wherein said movable block has an upper end surface, said rail has a lower end surface, and said upper end surface and said lower end surface are spaced from each other by a gap.

4. An apparatus according to claim 3, further comprising:

a second dump passage communicating with said paint trap near said first valve body; and a second dump valve for opening and closing said second dump passage, wherein said first dump valve for opening and closing said first dump passage branched from said paint supply passage and said second dump valve for opening and closing said second dump passage communicating with said paint trap are both disposed in said movable block near said first on/off valve.

5. An apparatus according to claim 1, further comprising:

an intermediate paint trap tank communicating with said second paint supply passage; and a casing, wherein said intermediate paint trap tank, said coating gun, and said insulating separator valve mechanism are housed in said casing.

6. An apparatus according to claim 5, further comprising:

a plurality of synthetic resin tubes for holding said intermediate paint trap tank in said casing, one of said synthetic resin tubes extending to said coating gun;

means for applying the high voltage; and a cable connected to said means for applying the high voltage and extending through said one of the synthetic resin tubes.

7. An apparatus for electrostatically coating a workpiece, comprising:

a coating gun to which a high voltage will be applied; and an insulating separator valve mechanism for electrically separating a paint supply passage for supplying an electrically conductive paint to said coating gun into a first paint supply passage to which a high voltage will be applied and a second paint supply passage to which no high voltage will be applied, said insulating separator valve mechanism comprising:

a first valve body connectable to said first paint supply passage through a first on/off valve;

a second valve body connectable to said second paint supply passage through a second on/off valve; and actuating means for detachably connecting said first valve body and said second valve body to each other, wherein said apparatus further comprises:

a communication hole defined when said first valve body and said second valve body are connected to each other;

a first dump passage branched from said communication hole near said first valve body;

a first dump valve connected to said first dump passage for opening and closing said first dump passage; and a first cleaning medium supply passage disposed near said second valve body for cleaning said communication hole through a first cleaning valve.

8. An apparatus according to claim 7, further comprising a second cleaning medium supply passage connected to said first dump passage near said first dump valve, for supplying a cleaning medium through a second cleaning valve to said communication hole to clean said paint supply passage.

9. An apparatus according to claim 7, further comprising:

second dump passage branched from said communication hole near said first valve body; and a second dump valve for opening and closing the second dump passage.

10. An apparatus according to claim 7, further comprising:

a movable block comprising said first valve body; and a rail having a substantially arch-shaped cross section, said movable block being movably supported on said rail, wherein said movable block has an upper end surface, said rail has a lower end surface, and said upper end surface and said lower end surface are spaced from each other by a gap.

11. An apparatus according to claim 10, further comprising:

a second dump passage branched from said communication hole near said first valve body;

a second dump valve for opening and closing the second dump passage, wherein said first dump valve for opening and closing said first dump passage branched from said communication hole and said second dump valve for opening and closing said second dump passage branched from said communication hole are disposed in said movable block near said first on/off valve.

12. An apparatus according to claim 7, further comprising:

an intermediate paint trap tank communicating with said second paint supply passage; and a casing, wherein said intermediate paint trap tank, said coating gun, and said insulating separator valve mechanism are housed in said casing.

13. An apparatus according to claim 12, further comprising:

a plurality of synthetic resin tubes for holding said intermediate paint trap tank in said casing, one of said synthetic resin tubes extending to said coating gun;

means for applying the high voltage; and a cable connected to said means for applying the high voltage and extending through said one of the synthetic resin tubes.

14. An apparatus for electrostatically coating a workpiece, comprising:

a coating gun;

a paint supply passage for supplying an electrically conductive paint to said coating gun; and an insulating separator valve mechanism for electrically separating a dump passage branched from said paint supply passage for discharging a drain liquid including the electrically conductive paint, into a first dump passage to which a high voltage will be applied and a second dump passage, said insulating separator valve mechanism comprising:

a first connector having a first on/off valve connected to said first dump passage and having branch passages connected to a cleaning medium supply source upstream of said first on/off valve; and a second connector having a second on/off valve connected to said second dump passage, wherein said apparatus further comprises:

third on/off valves disposed respectively in said branch passages for connecting a liquid medium supply source from a junction between said first connector and said second connector to said second dump passage while said first connector and said second connector are connected to each other.

15. An apparatus according to claim 14, wherein said first connector comprises a fixed block, said first on/off valve and said third on/off valves being disposed in said fixed block, said fixed block having a fourth on/off valve disposed in a portion of said paint supply passage to which the high voltage will be applied, for supplying the electrically conductive paint, and said second connector comprises a movable block, said second on/off valve being disposed in said movable block, said movable block having a fifth on/off valve disposed in another portion of said paint supply passage to which no high voltage will be applied.

16. An apparatus according to claim 15, wherein said fixed block and said movable block have first valve bodies, respectively, detachably connected for joining said portion of said paint supply passage to which the high voltage will be applied and said portion of said paint supply passage to which no high voltage will be applied.

17. An apparatus for electrostatically coating a workpiece, comprising:

a coating gun;

an insulating separator valve mechanism for electrically separating a paint supply passage for supplying an electrically conductive paint to said coating gun into a first paint supply passage connected to a paint supply source and a second paint supply passage to which a high voltage will be applied, said insulating separator valve mechanism comprising:

a first connector having a first on/off valve connected to said first paint supply passage; and a second connector having a second on/off valve connected to said second paint supply passage; and branch passages connected to a cleaning medium supply source upstream of said second on/off valve, said first and second connectors being connected respectively to said branch passages, wherein said apparatus further comprises:

an openable third on/off valve connected to one of said branch passages; and a closable fourth on/off valve connected to another of said branch passages, wherein when said second on/off valve is closed, said openable third on/off valve and said closable fourth on/off valve are connected to each other to expel air trapped in a junction between said first and second connectors into a portion of the branch passages under pressure of the electrically conductive paint supplied from said first paint supply passage.

18. An apparatus according to claim 17, wherein said first connector includes a movable block comprising said first on/off valve and said second connector includes a fixed block comprising said second on/off valve, said third on/off valve, and said fourth on/off valve.

* * * * *